US006546105B1

(12) United States Patent
Katayama et al.

(10) Patent No.: US 6,546,105 B1
(45) Date of Patent: Apr. 8, 2003

(54) SOUND IMAGE LOCALIZATION DEVICE AND SOUND IMAGE LOCALIZATION METHOD

(75) Inventors: Takashi Katayama, Hirakata (JP); Masaharu Matsumoto, Katano (JP); Masahiro Sueyoshi, Hirakata (JP); Shuji Miyasaka, Neyagawa (JP); Takeshi Fujita, Takatsuki (JP); Akihisa Kawamura, Hirakata (JP); Kazutaka Abe, Kadoma (JP); Kousuke Nishio, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/431,092

(22) Filed: Nov. 1, 1999

(30) Foreign Application Priority Data

Oct. 30, 1998 (JP) ..... 10-310969

(51) Int. Cl.[7] ..... H04R 5/00
(52) U.S. Cl. ..... 381/17; 381/1
(58) Field of Search ..... 381/1, 17, 61, 381/310

(56) References Cited

U.S. PATENT DOCUMENTS 5,440,639 A * 8/1995 Suzuki et al. ..... 381/17
5,946,400 A * 8/1999 Matsuo ..... 381/1
5,974,152 A * 10/1999 Fujinami ..... 381/1

* cited by examiner

*Primary Examiner*—Forester W. Isen
*Assistant Examiner*—Brian Tyrone Pendleton
(74) *Attorney, Agent, or Firm*—Wenderoth, Lind & Ponack, L.L.P.

(57) ABSTRACT

A sound image localization apparatus comprises a signal source for outputting an audio signal; a localization angle input unit for receiving an angle of a sound image to be localized; a coefficient control unit for receiving sound image localization angle information from the localization angle input unit, reading coefficients from a coefficient memory in accordance with the information, and outputting the coefficients; first, second, and third multipliers for multiplying the audio signal output from the signal source by using first, second, and third coefficients output from the coefficient control means, respectively; a first signal processing unit for receiving the output from the second multiplier, and processing it by using a filter having a predetermined first frequency response; a second signal processing unit for receiving the output from the second multiplier, and processing it by using a filter having a predetermined second frequency response; a first adder for adding the output from the first multiplier and the output from the first signal processing unit to output the sum; a second adder for adding the output from the third multiplier and the output from the second signal processing unit to output the sum; a first output unit for outputting the output of the first adder; and a second output unit for outputting the output of the second adder.

32 Claims, 20 Drawing Sheets

SOUND IMAGE LOCALIZATION DEVICE AND SOUND IMAGE LOCALIZATION METHOD

FIELD OF THE INVENTION

The present invention relates to a sound image localization device and a sound image localization method and, more particularly, to a construction for localizing a virtual sound image, in an arbitrary position, in AV (Audio, Visual) equipment.

BACKGROUND OF THE INVENTION

Recently, in the fields of movie and broadcasting, multi-channel audio signals (e.g., 5.1 channel) are recorded and reproduced by using digital audio compression techniques. However, such multi-channel audio signals cannot be reproduced by an ordinary television for domestic use because the audio output of the television for domestic use is usually two or less channels. Therefore, it is expected to realize the effect of multi-channel reproduction even in such AV equipment having two-channel audio reproduction function by using the technique of sound field control or the sound image control.

FIG. 2 is a block diagram illustrating the fundamental structure of a sound image localization apparatus (sound image reproduction apparatus) according to a prior art. Initially, description will be given of a method for localizing a sound image in a position on the forward-right to the front of a listener 9 by using speakers of output units 6*a* and 6*b* which are placed in front of the listener 9. As shown in FIG. 2, the sound image localization apparatus includes a sound source 1, signal processing means 5*a* and 5*b*, and output units 6*a* and 6*b*.

The signal source 1 is signal input means for inputting a PCM (Pulse Code Modulated) audio signal S(t). A localization angle input unit 2 is an input unit for localization information of a virtual speaker 8. A coefficient control unit 3 reads, from a coefficient memory 4, filter coefficients for localizing the virtual speaker at an angle according to the information from the localization angle input unit 2, and sets the filter coefficients in the signal processing means 5*a* and 5*b*. The signal processing means 5*a* is a digital filter having filter characteristics (transfer characteristics) hL(n) which are set by the coefficient control unit 3, and the signal processing means 5*b* is a digital filter having filter characteristics (transfer characteristics) hR(n) which are set by the coefficient control unit 3.

The output unit 6*a* converts the digital output supplied from the signal processing means 5*a* to an analog audio signal to be output. Likewise, the output unit 6*b* converts the digital output supplied from the signal processing means 5*b* to an analog audio signal to be output.

FIG. 3 is a block diagram illustrating the structure of the signal processing means 5*a* or 5*b*. The signal processing means 5*a* or 5*b* is an FIR (Finite Impulse Response) filter comprising n stages of delay elements (D) 13*a*~13*n*, n+1 pieces of multipliers 14*a*~14(n+1), and an adder 15. Input and output terminals of the respective delay elements 13 are connected with the respective multipliers 14, and the outputs from the respective multipliers 14 are added by the adder 15.

Now, the operation of the prior art sound image localization apparatus will be described with reference to FIGS. 2 and 3. In FIG. 2, a head-related transfer function between a speaker and an ear of the listener is called "impulse response", and the value of an impulse response between the output unit 6*a* (speaker) and the left ear of the listener is given by h1(t). Hereinafter, impulse response is used when describing the operation in the time domain. Although the impulse response h1(t) is precisely the response in the position of the eardrum of the left ear of the listener when inputting an audio signal to the output unit 6*a*, measurement is performed in the position of the entrance of the external auditory miatus. The same result will be obtained even when considering the operation in the frequency domain.

Likewise, h2(t) is an impulse response between the output unit 6*a* and the right ear of the listener. Further, h3(t) is an impulse response between the output unit 6*b* and the left ear of the listener, and h4(t) is an impulse response between the output unit 6*b* and the right ear of the listener.

A virtual speaker 8 is a virtual sound source which is localized in a position on the forward-right to the front of the listener. Further, h5(t) is an impulse response between the virtual speaker 8 and the left ear of the listener, and h6(t) is an impulse response between the virtual speaker 8 and the right ear of the listener.

In the sound image localization apparatus so constructed, when the audio signal S(t) from the signal source 1 is output from the virtual speaker 8, the sounds reaching the left and right ears of the listener 9 are represented by the following formulae (1) and (2), respectively.

$$\text{left ear: } L(t)=S(t)*h5(t) \tag{1}$$

$$\text{right ear: } R(t)=S(t)*h6(t) \tag{2}$$

wherein * represents convolutional arithmetic operation. Actually, these sounds are multiplied by the speaker's transfer function or the like, but it is ignored here to simplify the description. Alternatively, it may be assumed that the speaker's transfer function or the like is included in h5(t) and h6(t).

Further, the impulse responses and the signal S(t) are regarded as time-wise discrete digital signals, which are represented as follows.

L(t)→L(n)

R(t)→R(n)

h5(t)→h5(n)

h6(t)→h6(n)

S(t)→S(n)

wherein n represents integers. When T is the sampling time, n in ( ) should be nT, precisely. However, T is omitted here.

At this time, formulae (1) and (2) are represented as the following formulae (3) and (4), respectively, and the symbol * of convolutional operation is replaced with the multiplication symbol ×.

$$L(n)=S(n)\times h5(n) \tag{3}$$

$$R(n)=S(n)\times h6(n) \tag{4}$$

Likewise, when the signal S(t) is output from the output units 6*a* and 6*b*, the sound reaching the left ear of the listener is represented by the following formula (5).

$$L'(t)=S(t)*hL(t)*h1(t)+S(t)*hR(t)*h3(t) \tag{5}$$

When the signal S(t) is output from the output units 6*a* and 6*b*, the sound reaching the right ear of the listener is represented by the following formula (6.

$$R'(t)=S(t)*hL(t)*h2(t)+S(t)*hR(t)*h4(t) \tag{6}$$

When formulae (5) and (6) are represented by using (n) for the impulse responses, the following formulae (8) and (9) are obtained.

$$L'(n)=S(n)\times hL(n)\times h1(n)+S(n)\times hR(n)\times h3(n) \quad (8)$$

$$R'(n)=S(n)\times hL(n)\times h2(n)+S(n)\times hR(n)\times h4(n) \quad (9)$$

wherein hL(n) is the transfer characteristics of the signal processing means 5*a*, and hR(n) is the transfer characteristics of the signal processing means 5*b*.

It is premised that, when the head-related transfer functions are equal, the listener hears the sounds from the same direction. This premise is generally correct. If the relationship of formula (10) is satisfied, formula (11) is established.

$$L(n)=L(n) \quad (10)$$

$$h5(n)=hL(n)\times h1(n)+hR(n)\times h3(n) \quad (11)$$

Likewise, if the relationship of formula (12) is satisfied, formula (13) is established.

$$R(n)=R'(n) \quad (12)$$

$$h6(n)=hL(n)\times h2(n)+hR(n)\times h4(n) \quad (13)$$

In order to make the listener hear a predetermined sound from the position of the virtual speaker 8 by using the output units 6*a* and 6*b*, the values of hL(n) and hR(n) are decided so as to satisfy formulae (11) and (13). For example, when formulae (11) and (13) are converted into the frequency-domain expression, the convolutional operation is replaced with multiplication and, thereafter, the respective impulse responses are subjected to FFT (Fast Fourier Transform) to be transfer functions. Since the transfer functions other than that of the FIR filter are obtained by measurement, the transfer function of the FIR filter can be obtained from these two formulae.

Using hL(n) and hR(n) so decided, the signal S(n) convoluted with hL,(n) is output from the output unit 6*a* while the signal S(n) convoluted with hR(n) is output from the output unit 6*b*, whereby the listener 9 can feel the sound coming from the forward-right position even though the virtual speaker 8 does not sound actually. The FIR filter shown in FIG. 3 can localize the sound image at an arbitrary position by the signal processing described above.

Next, a description will be given of the case where the angle of the virtual speaker 8 is changed in the sound image localization apparatus.

In order to localize the virtual speaker 8 at a desired angle, the filter coefficients hL(n) and hR(n) of the signal processing means 5*a* and 5*b* must be set so as to localize the virtual speaker 8 at the desired angle. Since the filter coefficients vary according to the angle, filter coefficients of the same number as the angles to be set are required.

So, all of the filter coefficients corresponding to the respective angles to be set are stored in the coefficient memory 4. According to the angle of the virtual speaker 8, the filter coefficients for realizing the virtual speaker 8 are transferred from the coefficient memory 4 to the signal processing means 5*a* and 5*b*, followed by the sound image localization process. Thereby, the sound image localization apparatus can cope with the case where the angle of the virtual speaker 8 is changed.

The prior art apparatus and method for sound image localization are constructed as described above, and the virtual speaker can be localized with the variable angle. However, when the number of the angles of the virtual speaker 8 increases, since the coefficient memory 4 must store the filter coefficients as many as the angles, a large-capacity memory is required as the coefficient memory 4. Further, when a plurality of virtual speakers are realized in a multi-channel system, it is necessary to provide the sound image localization apparatuses as many as the virtual speakers. As the result, required computations, memory capacity, and system size are undesirably increased.

SUMMARY OF THE INVENTION

The present invention is made to solve the above-described problems and has for its object to provide a sound image localization apparatus which can realize virtual speakers of plural angles by using less parameters.

It is another object of the present invention to provide a sound image localization apparatus and a sound, image localization method which can be realized with less computational complexity and less memory capacity even in a multi-channel system.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, there is provided a sound image localization apparatus comprising: a signal source for outputting an audio signal; a localization angle input device for receiving an angle of a sound image to be localized; a coefficient control device for receiving sound image localization angle information from the localization angle input device, reading coefficients from a coefficient memory in accordance with the sound image localization angle information, and outputting the coefficients; first, second, and third multipliers for multiplying the audio signal output from the signal source by using first, second, and third coefficients output from the coefficient control device, respectively, and outputting the products; a first signal processing device for receiving the output from the second multiplier, and processing it by using a filter having a predetermined first frequency response; a second signal processing device for receiving the output from the second multiplier, and processing it by using a filter having a predetermined second frequency response; a first adder for receiving the output from the first multiplier and the output from the first signal processing device, and adding these outputs to output the sum; a second adder for receiving the output from the third multiplier and the output from the second signal processing device, and adding these outputs to output the sum; a first output unit for outputting the output of the first adder; and a second output unit for outputting the output of the second adder. Therefore, the virtual speaker can be localized in an arbitrary position by controlling only the coefficients of the multipliers according to the angle of the virtual speaker. As the result, a sound image localization apparatus capable of controlling the position of the virtual speaker can be realized with a coefficient memory of smaller capacity and reduced computations, as compared with those of the prior art apparatus.

According to a second aspect of the present invention, there is provided a sound image localization apparatus comprising: a signal source for outputting an audio signal; a localization angle input device for receiving an angle of a sound image to be localized; a coefficient control device for receiving sound image localization angle information from the localization angle input means, reading coefficients from a coefficient memory in accordance with the sound image localization angle information, and outputting the coefficients; first, second, and third multipliers for multiplying the audio signal output from the signal source by using first, second, and third coefficients output from the coefficient control device, respectively, and outputting the products; a signal processing device for receiving the output from the second multiplier, and processing it by using a filter having a predetermined frequency response; an adder for receiving the output from the third multiplier and the output from the signal processing device, and adding these outputs to output the sum; a first output unit for outputting the output of the first multiplier; and a second output unit for outputting the output of the adder. Therefore, the virtual speaker can be localized in an arbitrary position by controlling only the coefficients of the multipliers according to the angle of the virtual speaker. As the result, a sound image localization apparatus capable of controlling the position of the virtual speaker can be realized with a coefficient memory of smaller capacity and reduced computations, as compared with those of the prior art apparatus. Further, the construction of the apparatus can be simplified.

According to a third aspect of the present invention, there is provided a sound image localization apparatus comprising: a plurality of signal sources for outputting audio signals; a localization angle input device for receiving an angle of a sound image to be localized; a coefficient control device for receiving sound image localization angle information from the localization angle input device, reading coefficients from a coefficient memory in accordance with the sound image localization angle information, and outputting the coefficients; a plurality of signal input units provided correspondingly to the respective signal sources, each input unit having first, second, and third multipliers for multiplying the audio signal output from the corresponding signal source by using first, second, and third coefficients from the coefficient control device, respectively, and outputting the products; a first adder for summing all of the outputs from the first multipliers of the input units; a second adder for summing all of the outputs from the second multipliers of the input units; a third adder for summing all of the outputs from the third multipliers of the input units; a first signal processing device for receiving the output from the second adder, and processing it by using a filter having a predetermined first frequency response; a second signal processing device for receiving the output from the second adder, and processing it by using a filter having a predetermined second frequency response; a fourth adder for receiving the output from the first adder and the output from the first signal processing device, and adding these signals to output the sum; a fifth adder for receiving the output from the third multiplier and the output from the second signal processing device, and adding these signals to output the sum; a first output unit for outputting the output of the fourth adder; and a second output unit for outputting the output of the fifth adder. Therefore, the virtual speaker can be localized in an arbitrary position. As the result, even in a multi-channel system, a sound image localization apparatus capable of controlling the position of the virtual speaker can be realized with a coefficient memory of smaller capacity and reduced computations as compared with those of the prior art apparatus.

According to a fourth aspect of the present invention, there is provided a sound image localization apparatus comprising: a plurality of signal sources for outputting audio signals; a localization angle input device for receiving an angle of a sound image to be localized; a coefficient control device for receiving sound image localization angle information from the localization angle input device, reading coefficients from a coefficient memory in accordance with the sound image localization angle information, and outputting the coefficients; signal input units provided corresponding to the respective signal sources, each input unit having first, second, and third multipliers for multiplying the audio signal output from the corresponding signal source by using first, second, and third coefficients output from the coefficient control device, respectively, and outputting the products; a first adder for summing all of the outputs from the first multipliers of the input units; a second adder for summing all of the outputs from the second multipliers of the input units; a third adder for summing all of the outputs from the third multipliers of the input units; a signal processing device for receiving the output from the second adder, and processing it by using a filter having a predetermined frequency response; a fourth adder for receiving the output from the third multiplier and the output from the signal processing means, and adding these signals to output the sum; a first output unit for outputting the output of the first adder; and a second output unit for outputting the output of the fourth adder. Therefore, the virtual speaker can be localized in an arbitrary position. As the result, even in a multi-channel system, a sound image localization apparatus capable of controlling the position of the virtual speaker can be realized with a coefficient memory of smaller capacity and reduced computations, as compared with those of the prior art apparatus. Further, the construction of the apparatus can be simplified.

According to a fifth aspect of the present invention, any of the above-described sound image localization apparatuses further comprises a filter device for receiving filter coefficients of the predetermined frequency response from the coefficient control device, and processing the signal from the signal source. The first, second, and third multipliers multiply, not the output signal from the signal source, but the output from the filter device by using the first, second, and third coefficients from the coefficient control device, respectively. Therefore, a sound image localization apparatus capable of controlling the position of the virtual speaker and having a sound quality as high as that of the prior art apparatus, can be realized with a coefficient memory of smaller capacity and reduced computations, as compared with those of the prior art apparatus.

DETAILED DESCRIPTION OF THE PREFERRED EMBODIMENTS

Embodiment 1

Figure 1:
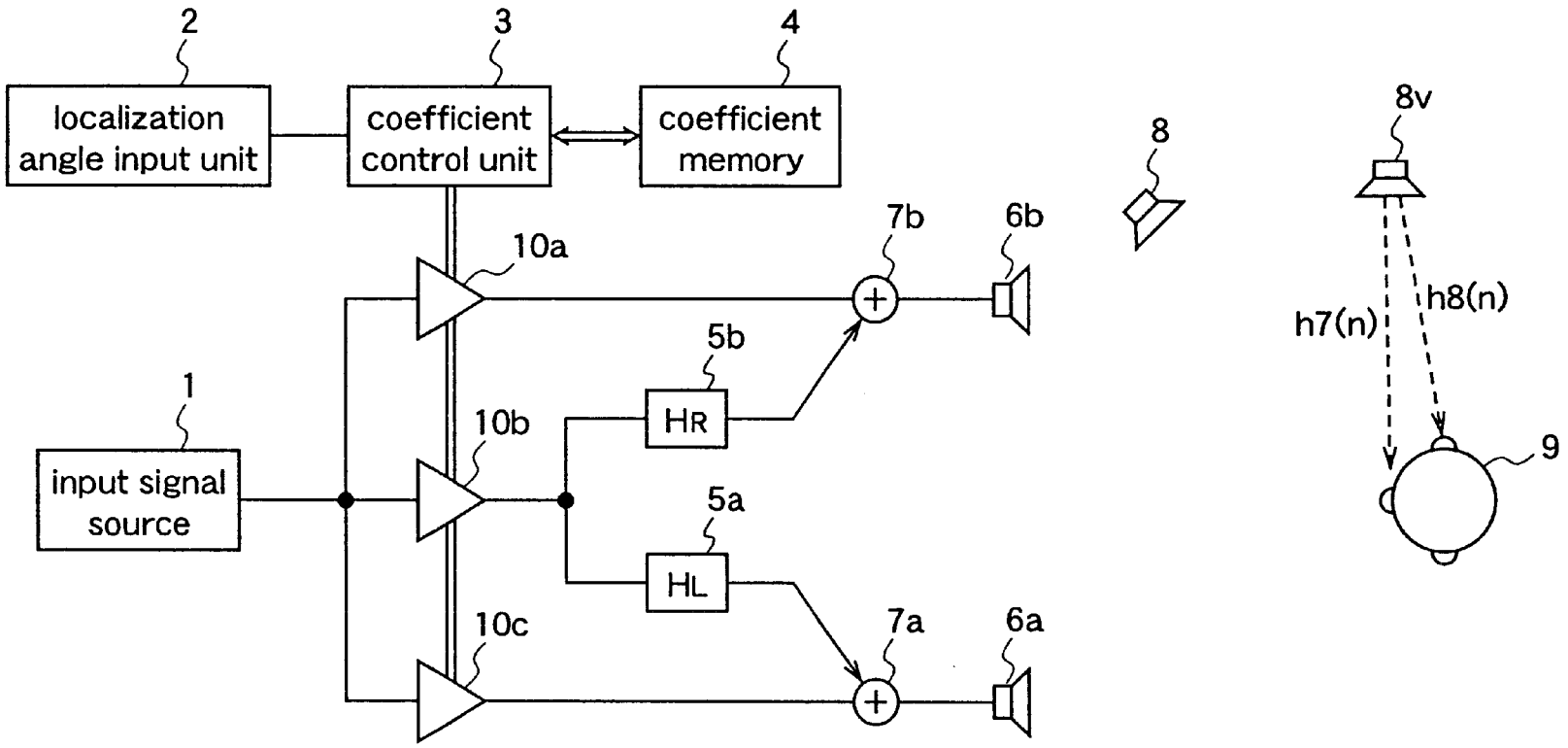
FIG. 1 is a block diagram illustrating the structure of a sound image localization apparatus according to a first embodiment of the present invention.
Figure 2:
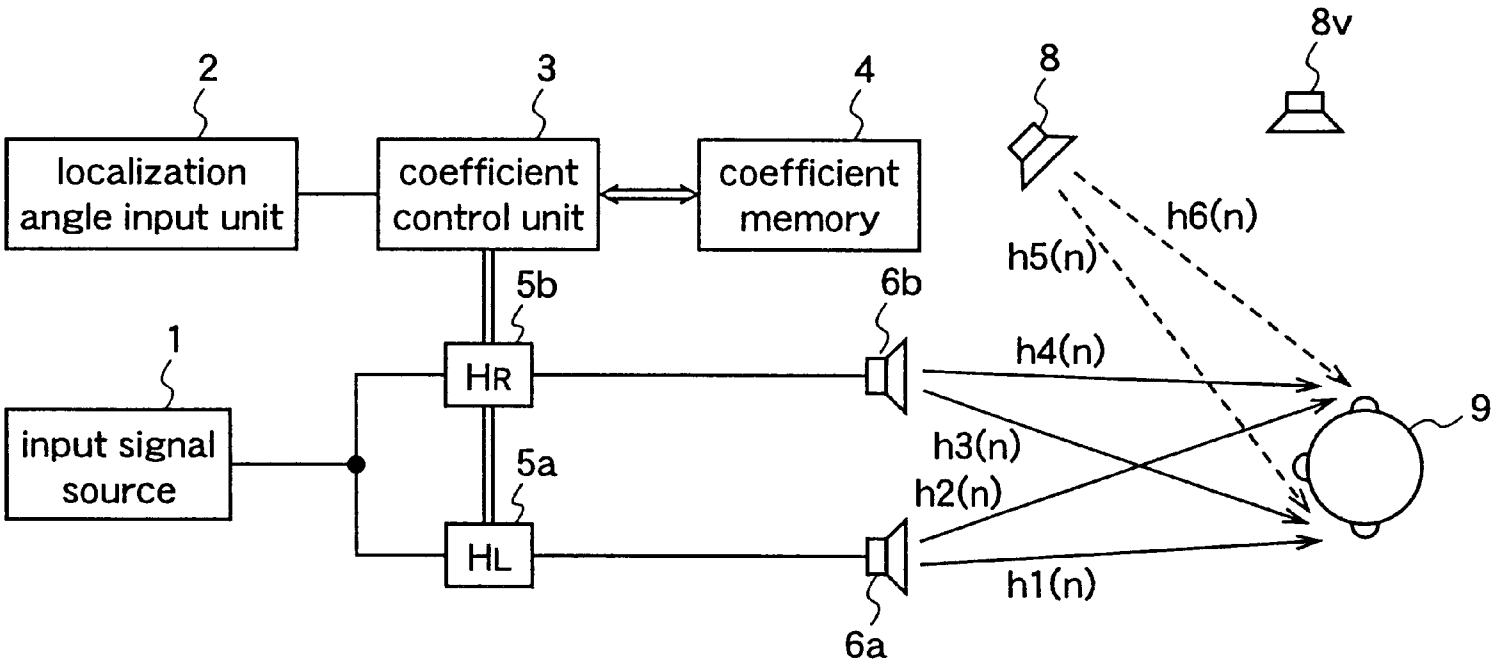
Fig.2 Prior Art
FIG. 2 is a block diagram illustrating the structure of a sound image localization apparatus according to the prior art.

Hereinafter, a sound image localization apparatus according to a first embodiment of the present invention will be described with reference to FIG. 1. FIG. 1 is a block diagram illustrating the entire structure of a sound image localization apparatus according to the first embodiment of the present invention. In FIG. 1, the same reference numerals as those shown in FIG. 2 designate the same or corresponding parts. In the sound image localization apparatus shown in FIG. 1, a first multiplier 10*c*, a second multiplier 10*b*, and a third multiplier 10*a* and a first adder 7*a* and a second adder 7*b* are provided in addition to the constituents of the prior art apparatus shown in FIG. 2. Further, the coefficients of the multipliers 10*a*, 10*b* and 10*c* are controlled by the coefficient control unit 3 in this first embodiment while the coefficients of the first signal processing device 5*a* and the second signal processing device 5*b* are controlled in the prior art apparatus.

With reference to FIG. 1, in this first embodiment, the first output unit 6*a* is positioned on the forward-left to the front of the listener 9, the second output unit 6*b* is positioned on the forward-right to the front of the listener 9, the virtual speaker 8 (desired second virtual sound image) is positioned diagonally to the forward-right of the listener 9, and the virtual speaker 8V (first virtual sound image) is positioned on the right aide of the listener 9.

Next, the operation of the sound image localization apparatus will be described. In FIG. 1, an analog-to-digital converted (PCM) audio signal is supplied from the signal source 1. This audio signal is input to the multipliers 10*a*, 10*b*, and 10*c*.

Further, desired angle information of the virtual speaker 8 is input to the localization angle input unit 2. The coefficient control unit 3 reads the coefficients for localizing thee virtual speaker 8 from the coefficient memory 4 according to the angle information supplied from the localization angle input unit 2, and then sets the coefficients in the multipliers 10*a*, 10*b*, and 10*c*.

The output of the multiplier 10*b* is input to the signal processing devices 5*a* and 5*b*, and subjected to filtering with predetermined frequency responses, respectively. Hereinafter, the predetermined frequency responses possessed by the signal processing devices 5*a* and 5*b* will be described.

Figure 3:
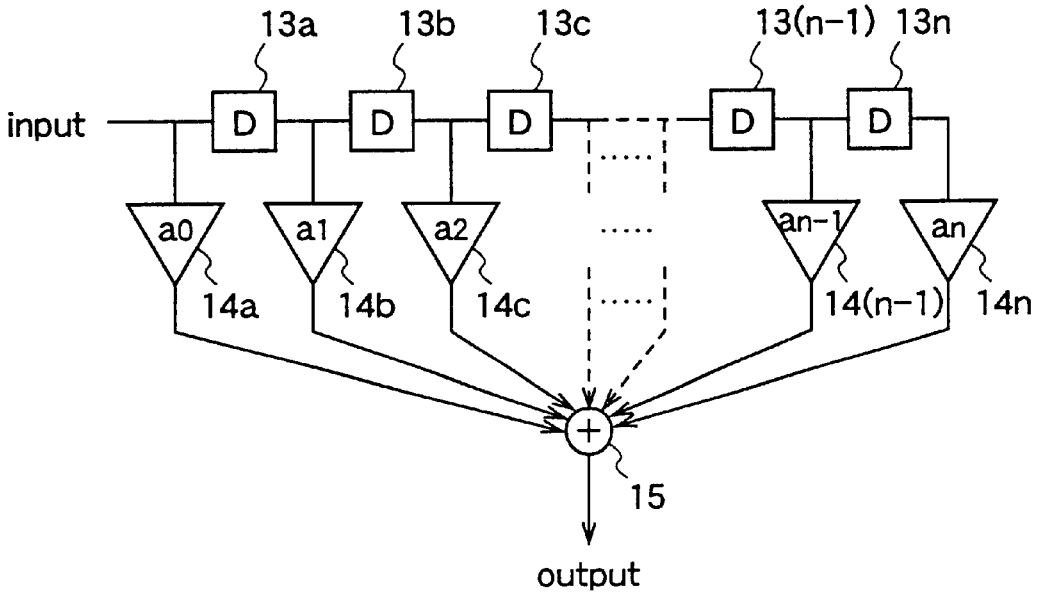
FIG. 3 is a block diagram illustrating the structure of an FIR filter used as signal processing device, in the embodiments of the present invention.
Figure 20:
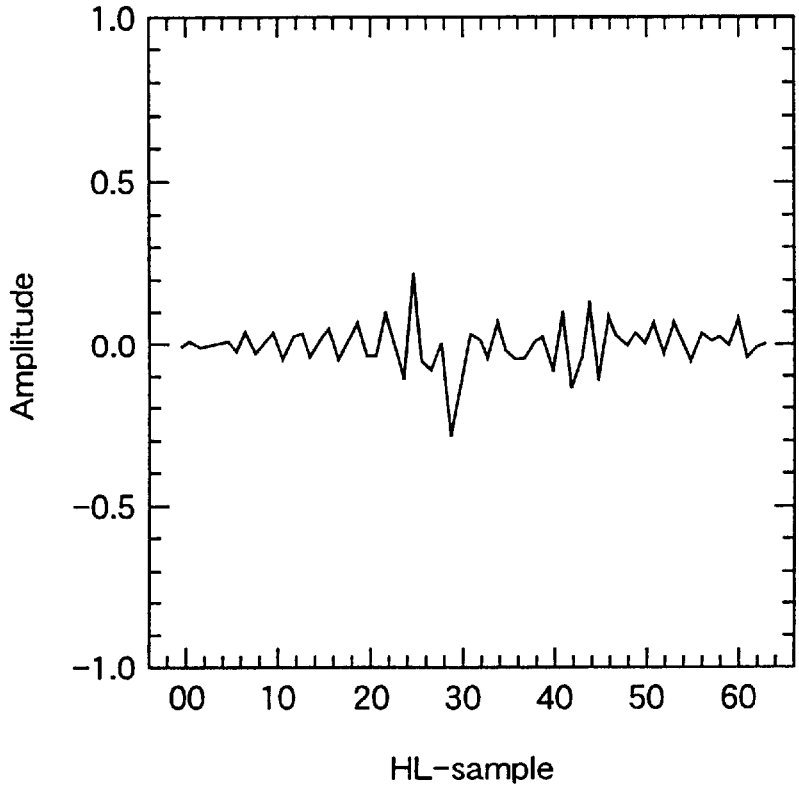
FIG. 20 is a diagram illustrating an example of filter coefficients of an FIR filter.
Figure 20:
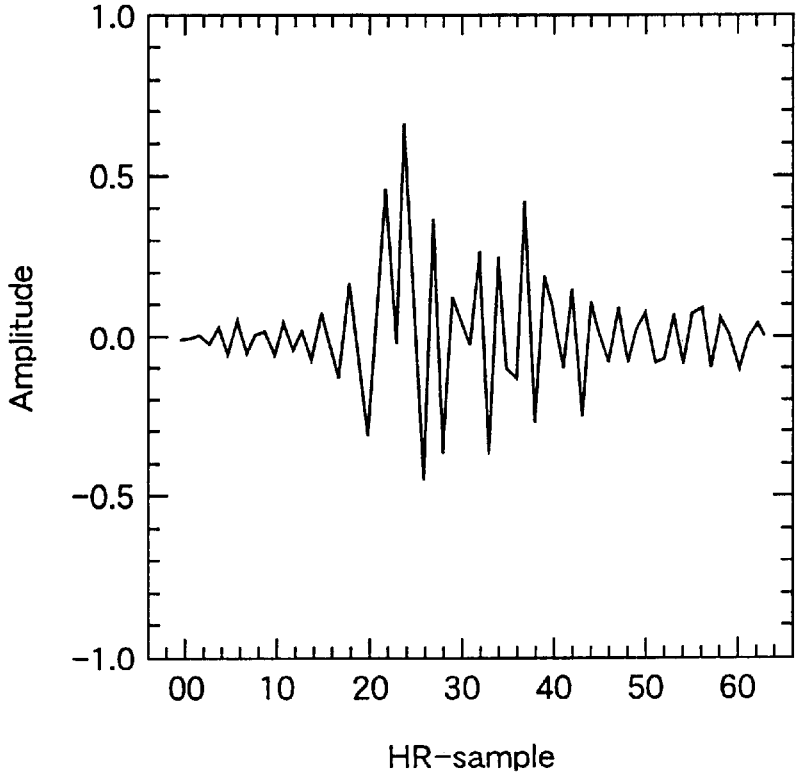

The above-described frequency responses are for localizing a sound image in the position of the predetermined virtual speaker 8V (first virtual sound image) which is positioned diagonally to the front of the listener or on a side of the listener when the outputs of the first signal processing device 5*a* and the second signal processing device 5*b* are directly output from the first output unit 6*a* and the second output unit 6*b*, respectively, and the filter has the structure of an FIR filter as shown in FIG. 3. An example of filter coefficients of this filter is shown in FIG. 20. This filter can be implemented by an IIR (Infinite Impulse Response) filter or an FIR+IIR hybrid filter. The method of computing the filter coefficients for localizing the virtual sound image in the position of the virtual speaker 8V can be given by replacing the transfer characteristics h5(n) and h6(n) employed in the prior art method with the transfer characteristics h7(n) and h8(n) in the position of the virtual speaker 8V.

The signal processed by the signal processing device 5*b* is added to the output of the multiplier 10*a* in the adder 7*b*, and the sum is converted to an analog signal and output from the output unit 6*b*. Further, the signal processed by the signal processing device 5*a* is added to the output of the multiplier 10*c* in the adder 7*a*, and the sum is converted to an analog signal and output from the output unit 6*a*.

Now, the method of controlling the coefficients of the multipliers 10*a*, 10*b*, and 10*c* will be described.

When only the coefficient of the multiplier 10*a* is 1.0 and the coefficients of the multipliers 10*b* and 10*c* are 0.0, the input signal is output as it is to the output unit 6*b*. In this case, the sound image of the virtual speaker 8 is localized in the position of the output unit 6*b*. Likewise, when only the coefficient of the multiplier 10*c* is 1.0 and the coefficients of the multipliers 10*a* and 10*b* are 0.0, the input signal is output as it is to the output unit 6*a*. In this case, the sound image of the virtual speaker 8 is localized in the position of the output unit 6*a*. When only the coefficient of the multiplier

10*b* is 1.0 and the coefficients of the multipliers 10*a* and 10*c* are 0.0, the input signal which has been filtered in the signal processing device 5*b* is output to the output unit 6*b* while the input signal which has been filtered in the signal processing device 5*a* is output to the output unit 6*a*. In this case, the sound image of the virtual speaker 8 is localized in the position of the virtual speaker 8V on the right side of the listener 9 on the right side of the listener 9.

Further, when the coefficient of the multiplier 10*c* is 0.0 and the coefficients of the multipliers 10*a* and 10*b* are varied, the position of the virtual speaker 8 is set at an angle between the output unit 6*b* and the virtual speaker 8V according to the ratio of the coefficient of the multiplier 10*a* to the coefficient of the multiplier 10*b*. This ratio depends on the predetermined frequency responses of the signal processing devices 5*b* and 5*a*. Generally, when the coefficient of the multiplier 10*a* is relatively larger than the coefficient of the multiplier 10*b*, the position of the virtual speaker 8 approaches the position of the output unit 6*b*. Conversely, when the coefficient of the multiplier 10*b* is relatively larger than the coefficient of the multiplier 10*a*, the position of the virtual speaker 8 approaches the position of the virtual speaker 8V. Likewise, when the coefficient of the multiplier 10*b* is 0.0 and the relative sizes of the coefficients of the multipliers 10*a* and 10*c* are controlled, the virtual speaker 8 can be localized between the output unit 6*b* and the output unit 6*a*.

As described above, by controlling the coefficients of the first multiplier 10*c*, the second multiplier 10*b*, and the third multiplier 10*a* in accordance with the desired angle of the virtual speaker 8, i.e., the sound image localization angle input to the localization angle input device, the virtual speaker 8 (desired second virtual sound image) can be localized in the position of the input angle. Further, the sound image localization angle input to the localization angle input device can be arbitrarily set in a range obtained by connecting the most distant two points amongst the following three points: the position in which. the output from the first output unit 6*a* is emitted to space, the position in which the output from the second output unit 6*b* is emitted to space, and the predetermined position of the virtual speaker 8V (first virtual sound image).

As described above, in the prior art, the coefficients of the signal processing devices 5*b* and 5*a* must be changed to change the sound image of the virtual speaker 8, and usually filters of about 128 taps are used as the signal processing devices 5*b* and 5*a*. Assuming that the angle of the virtual speaker 8 is controlled at five points, when a filter of n taps is used in the prior art apparatus, the number of coefficients to be stored in the coefficient memory 4 is given by $$n*2*5=10n$$

On the other hand, in this first embodiment, the number of coefficients to be stored in the coefficient memory 4 is given by $$3(\text{parameters of 3 multipliers})*5+n*2(\text{left and right signal processing devices})=15+2n$$

As the result, the required size of the coefficient memory 4 can be reduced to $$(15+2n)/10n=3/2n+1/5$$

If the filter's tap number n is 128 as described above, a reduction of about 79% is realized. Further, by reproducing the audio signal while varying the coefficients of the multipliers 10*a*, 10*b*, and 10*c*, the sound image of the virtual speaker 8 can be easily moved to a desired position.

In this case, the increment in computations is only product: number of arithmetic data*1 sum of products: number of arithmetic data*2 and this first embodiment can be realized with such a small increment in computations.

On the other hand, when using the filter of n taps, the computations of the signal processing devices (5*a* or 5*b*) are given by $$\text{product, sum of products: number of arithmetic data}*2n$$

As the result, according to this first embodiment, the increment in computations compared with the computations in the prior art method is 3/2n. When the filter's tap number n is 128, the increment in computations is only 1.1%, and the first embodiment of the invention can be realized with such small increment in computations.

As described above, according to the first embodiment of the invention, the sound image localization apparatus is provided with the multipliers 10*a*, 10*b* and 10*c* which are controlled by the coefficient control unit 3, and the input signal supplied from the signal source 1 is multiplied by the coefficients of these multipliers. The output from the multiplier 10*b* is input to the signal processing (BEG devices 5*a* and 5*b*, and the output from the signal processing device 5*b* is added to the output from the multiplier 10*a* in the adder 7*b* while the output from the signal processing device 5*a* is added to the output from the multiplier 10*b* in the adder 7*a*. Therefore, the position of the virtual speaker 8 can be varied by controlling the coefficients of the multipliers 10*a*, 10*b*, and 10*c*. As the result, a sound image localization apparatus capable of moving the sound image (hereinafter, referred to as a sound image movable localization apparatus) which is similar to the prior art apparatus, can be realized with a very small increment in computations as compared with the computations in the prior art method and a coefficient memory of smaller capacity than that of the prior art apparatus.

Embodiment 2

Figure 4:
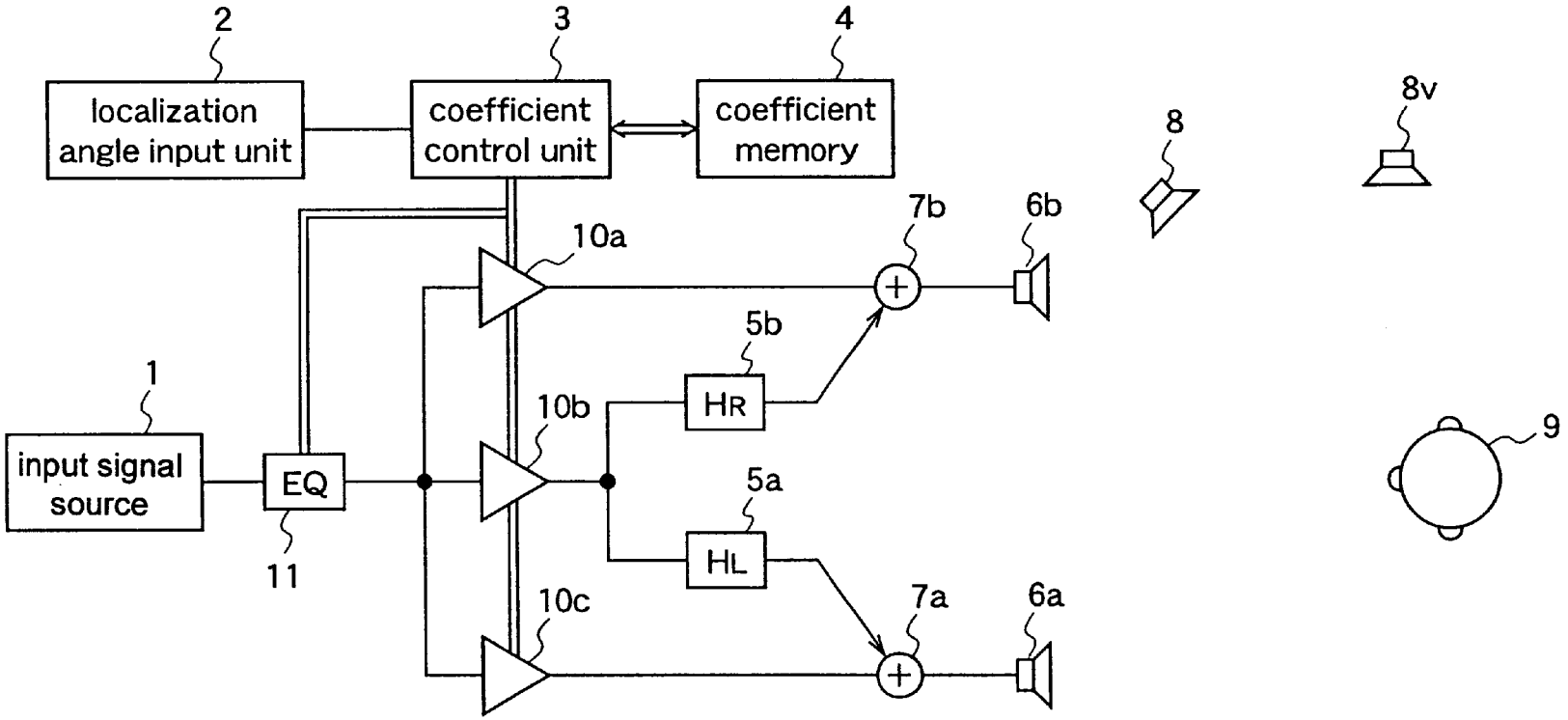
FIG. 4 is a block diagram illustrating the structure of a sound image localization apparatus according to a second embodiment of the present invention.

Hereinafter, a sound image localization apparatus according to a second embodiment of the present invention will be described with reference to figures. In the apparatus according to the first embodiment, the sound quality of the virtual speaker 8 (desired second virtual sound image) sometimes varies due to variations in the integrated transfer characteristics of the signal processing section comprising the first multiplier 10*c*, the second multiplier 10*b*, the third multiplier 10*a*, the first signal processing device 5*a*, the second signal processing device 5*b*, the first adder 7*a*, and the second adder 7*b*. So, in this second embodiment, the sound image localization apparatus is provided with a device for compensating the variations in the integrated transfer characteristics of the signal processing section. FIG. 4 is a block diagram illustrating the entire structure of the sound image localization apparatus according to the second embodiment. In FIG. 4, the same reference numerals as those shown in FIG. 1 designate the same or corresponding parts. Reference numeral 11 designates a filter unit which receives the filter coefficients of the predetermined frequency responses from the coefficient control unit 3 and processes the signal from the input signal source. This filter unit 11 is implemented by, for example, an equalizer.

Next, the operation of the sound image localization apparatus will be described. With reference to FIG. 4, angle information of the virtual speaker 8 is input to the localization angle input unit 2. The coefficient control unit 3 reads the coefficients for localizing the virtual speaker 8 from the coefficient memory 4 in accordance with the angle information from the localization angle input unit 2, and sets the coefficients in the filter unit 11 and the multipliers 10*a*~10*c*.

Further, an analog-to-digital converted (PCM) audio signal is supplied from the signal source 1. This audio signal is processed with a predetermined frequency response of the filter unit 11, and the processed signal is input to the multipliers 10*a*~10*c*.

The output from the multiplier 10*b* is input to the signal processing devices 5*a* and 5*b*, and subjected to filtering with predetermined frequency responses, respectively. Hereinafter, the predetermined frequency responses of the signal processing devices 5*a* and 5*b* will be described.

The above-described frequency responses are for localizing a sound image in the position of the predetermined virtual speaker 8V (first virtual sound image) which is positioned diagonally to the front of the listener or on a side of the listener, in the case where the outputs of the first signal processing device 5*a* and the second signal processing device 5*b* are directly output from the first output unit 6*a* and the second output unit 6*b*, respectively, and the filter has the structure of an FIR filter as shown in FIG. 3. An example of filter coefficients of this filter is shown in FIG. 20. This filter can be implemented by using an IIR filter or an FIR+IIR hybrid filter. The method of computing the filter coefficients for localizing the virtual sound image in the position of the virtual speaker 8V is given by replacing the transfer characteristics h5(n) and h6(n) employed in the prior art method with the transfer characteristics h7(n) and h8(n) in the position of the virtual speaker 8V.

The signal processed in the signal processing device 5*b* is added to the output of the multiplier 10*a* in the adder 7*b*, and the sum is converted to an analog signal and output from the output unit 6*b*. Likewise, the signal processed in the signal processing device 5*a* is added to the output of the multiplier 10*c* in the adder 7*a*, and the sum is converted to an analog signal and output from the output unit 6*a*.

Now, the method for controlling the coefficients of the multipliers 10*a*~10*c* will be described.

When only the coefficient of the multiplier 10*a* is 1.0 and the coefficients of the multipliers 10*b* and 10*c* are 0.0, the input signal is output as it is to the output unit 6*b*. In this case, the sound image of the virtual speaker 8 is localized in the position of the output unit 6*b*. Likewise, when only the coefficient of the multiplier 10*c* is 1.0 and the coefficients of the multipliers 10*a* and 10*b* are 0.0, the input signal is output as it is to the output unit 6*a*. In this case, the sound image of the virtual speaker 8 is localized in the position of the output unit 6*a*. When only the coefficient of the multiplier 10*b* is 1.0 and the coefficients of the multipliers 10*a* and 10*c* are 0.0, the input signal which has been filtered in the signal processing device 5*b* is output to the output unit 6*b*, and the input signal which has been filtered in the signal processing device 5*a* is output to the output unit 6*a*. In this case, the sound image of the virtual speaker 8 is localized in the position of the virtual speaker 8V.

Further, when the coefficient of the multiplier 10*c* is 0.0 and the coefficients of the multipliers 10*a* and 10*b* are varied, the position of the virtual speaker 8 is set at an angle between the output unit 6*b* and the virtual speaker 8V according to the ratio of the coefficient of the multiplier 10*a* to the coefficient of the multiplier 10*b*. This ratio depends on the predetermined frequency responses of the signal processing devices 5*b* and 5*a*. Generally, when the coefficient of the multiplier 10*a* is relatively larger than the coefficient of the multiplier 10*b*, the position of the virtual speaker 8 approaches the position of the output unit 6*b*. Conversely, when the coefficient of the multiplier 10*b* is relatively larger than the coefficient of the multiplier 10*a*, the position of the virtual speaker 8 approaches the position of the virtual speaker 8V. Likewise, when the coefficient of the multiplier 10*b* is 0.0 and the relative sizes of the coefficients of the multipliers 10*a* and 10*c* are controlled, the virtual speaker 8 can be localized between the output unit 6*b* and the output unit 6*a*.

Figure 11:
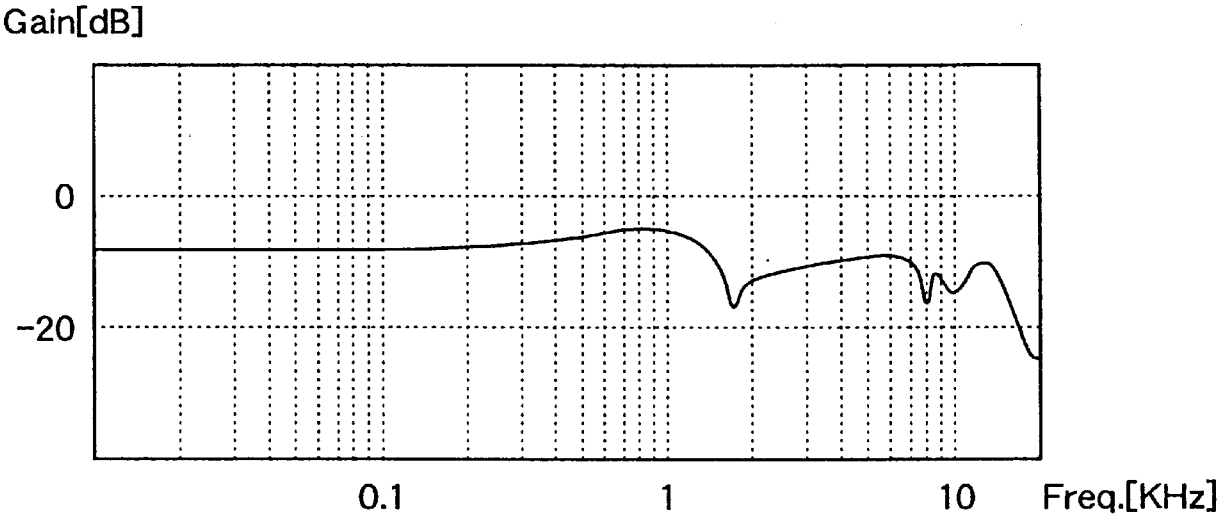
FIGS. 11(*a*) and 11(*b*) are diagrams illustrating the frequency responses, at both ears of the listener, of a sound from a virtual speaker 8V according to the first embodiment of the invention.
Figure 11:
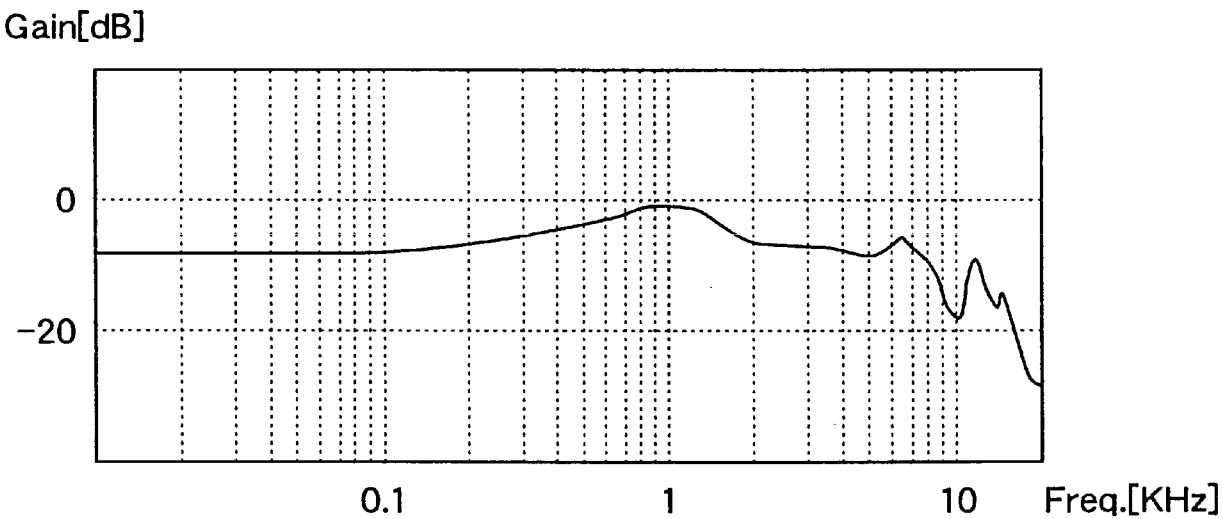
Figure 12:
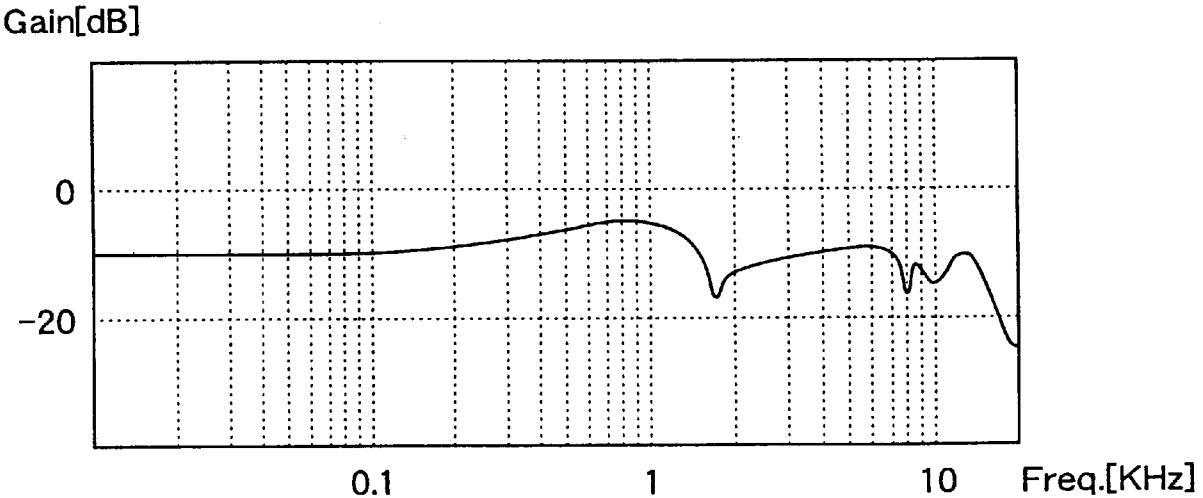
FIGS. 12(*a*) and 12(*b*) are diagrams illustrating the frequency responses, at both ears of the listener, of a sound from a virtual speaker 8 according to the second embodiment of the invention.
Figure 12:
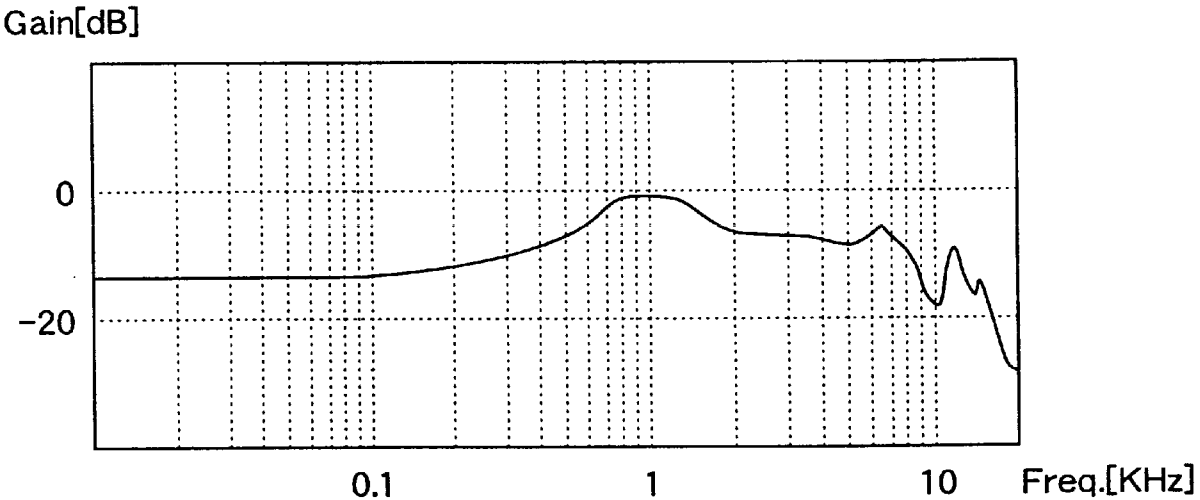

A description is now given of the integrated transfer characteristics of the signal processing section which comprises the multipliers 10*a*, 10*b*, and 10*c*, the signal processing devices 5*a* and 5*b*, and the adders 7*a* and 7*b* in the case where the above-described sound image localization is carried out. When the coefficients of the multipliers 10*a* and 10*c* are 0.0 and the coefficient of the multiplier 10*b* is 1.0, the frequency response of the virtual speaker 8 in the positions of the left and right ears of the listener 9 are shown in FIGS. 11(*a*) and 11(*b*). FIG. 11(*a*) shows the frequency response at the left ear of the listener 9, and FIG. 11(*b*) shows the frequency response at the right ear of the listener 9. When the coefficients of the multipliers 10*a* and 10*b* are set to 0.5, the frequency responses at the positions of the left and right ears of the listener 9 vary as shown in FIGS. 12(*a*) and 12(*b*). FIG. 12(*a*) shows the frequency response at the left ear of the listener 9, and FIG. 12(*b*) shows the frequency response at the right ear of the listener 9. When comparing FIGS. 11(*a*) and 11(*b*) with FIGS. 12(*a*) and 12(*b*), it can be seen that the frequency response of the virtual speaker, i.e., the sound quality, vary as the coefficients of the multipliers 10*a* and 10*b* vary. In this second embodiment, a reduction in the frequency components lower than 500 Hz is detected, and it is thought that the sound quantity is degraded by this reduction.

Figure 13:
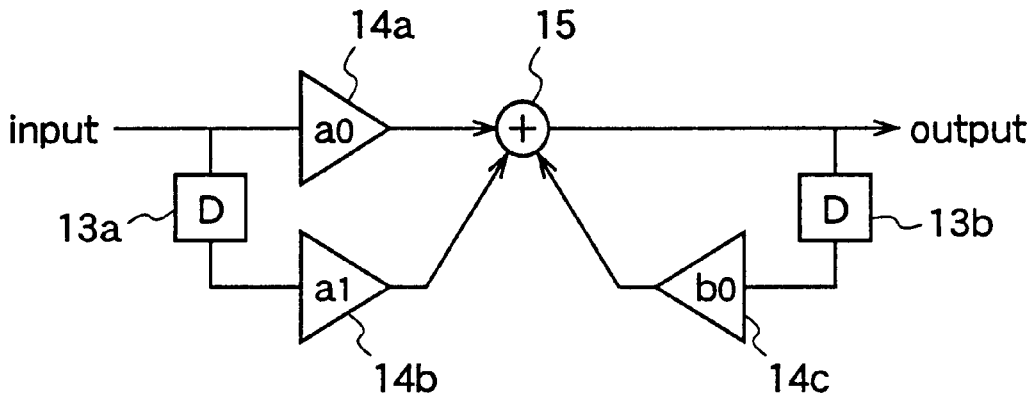
FIG. 13 is a block diagram illustrating a filter unit as a component of the sound image localization apparatus according to any of the second, fourth, sixth, and eighth embodiments of the invention.

So, this variation in the frequency response is compensated by using the filter unit 11. FIG. 13 is a block diagram illustrating an example of the construction of the filter unit 11. This filter unit 11 is an IIR filter comprising two delay elements (D) 13*a* and 13*b*, three multipliers 14*a*, 14*b*, and 14*c*, and an adder 15. The input terminal of the filter unit 11 and the output ends of the delay elements 13*a* and 13*b* are connected to the multipliers 14*a*, 14*b*, and 14*c*, respectively, and the outputs of these multipliers are added in the adder 15. Although in this second embodiment a first By order IIR filter is used, other filters, such as an FIR filter, an n-th order IIR filter, and an FIR+IIR filter, may be used. However, the computational complexity may vary according to the structure of the filter unit 11. Furthermore, the filter coefficients of the predetermined frequency response of the filter unit 11 compensate at least one of the sound quality, the change in sound volume, the phase characteristics, and the delay characteristics, amongst the frequency responses of the signal processing section which comprise the first multiplier 10*c*, the second multiplier 10*b*, the third multiplier 10*a*, the first signal processing device 5a, the second signal processing device 5*b*, the first adder 7*a*, and the second adder 7*b*.

Figure 14:
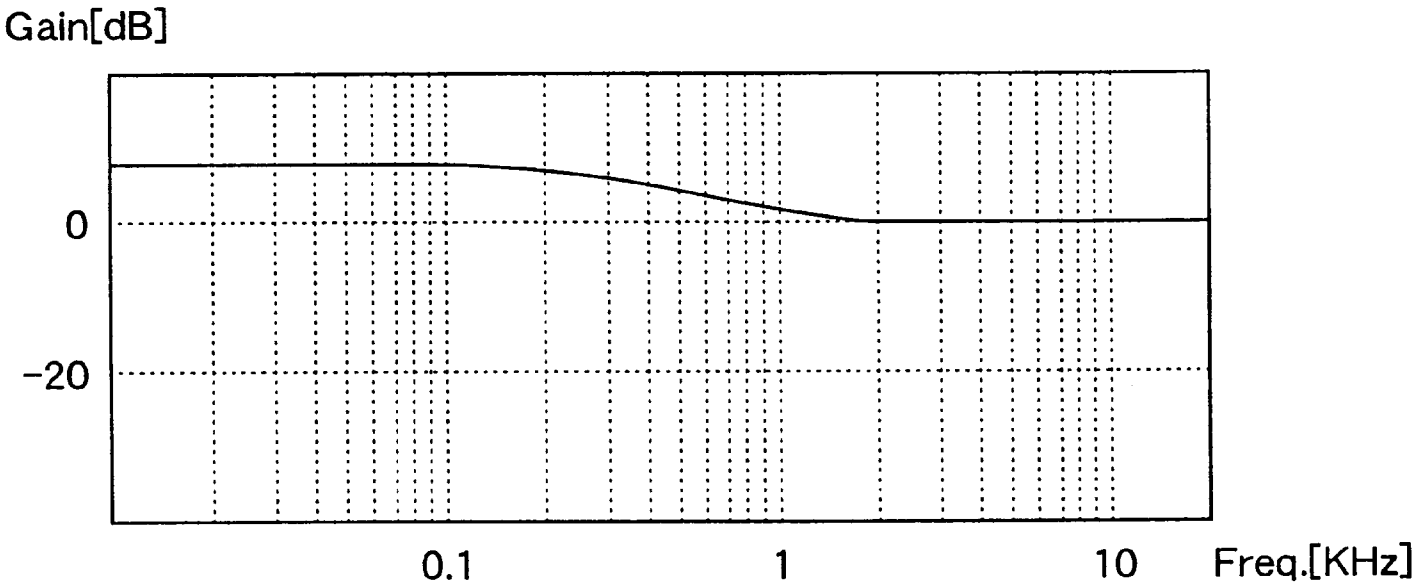
FIG. 14 is a diagram illustrating the frequency response of a filter unit according to the second or sixth embodiment of the invention.
Figure 15:
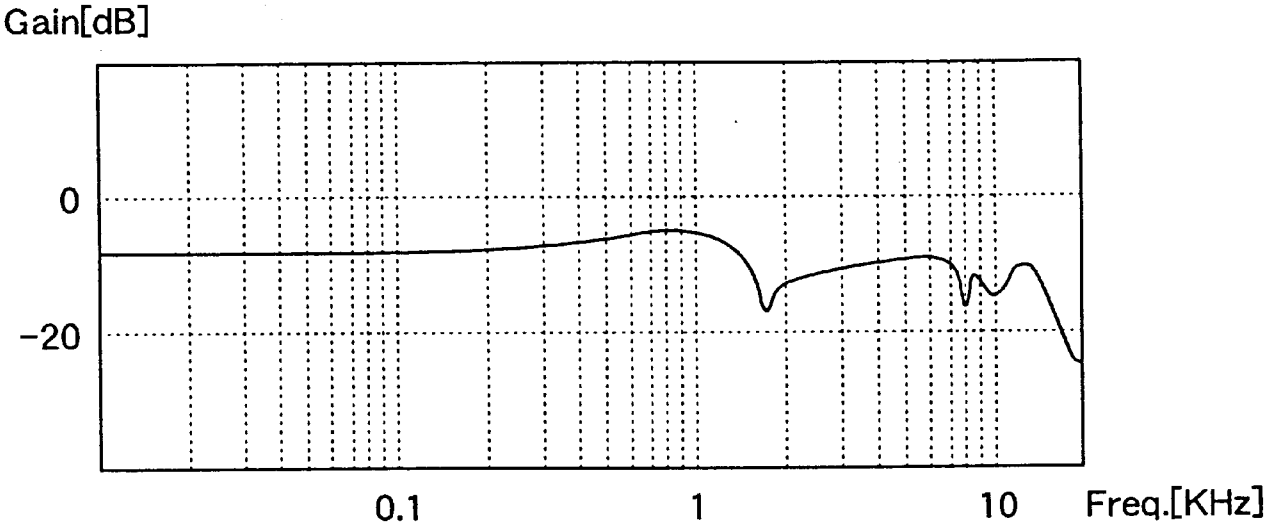
FIGS. 15(*a*) and 15(*b*) are diagrams illustrating the frequency responses, at both ears of the listener, of a sound from a virtual speaker 8 when it is compensated in the filter unit according to the second or sixth embodiment of the invention.
Figure 15:
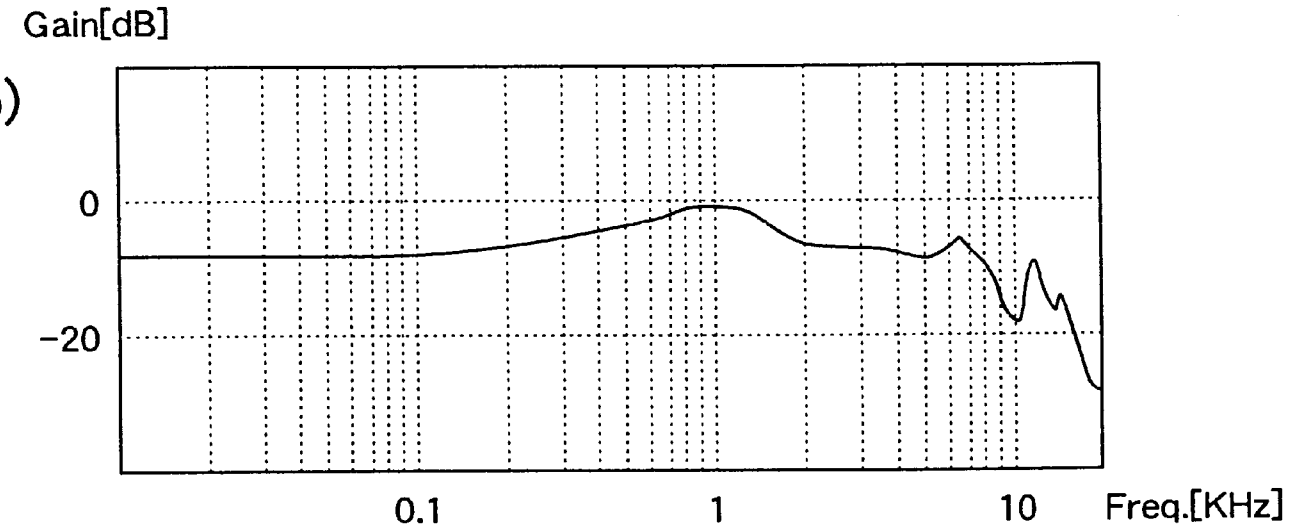

FIG. 14 shows an example of frequency response of the filter unit 11. When the frequency response of the input signal is compensated by using the frequency response of the filter unit 11 and the coefficients of the multipliers 10*a* and 10*b* are set to 0.5, the frequency responses in the positions of the left and right ears of the listener 9 become as shown in FIGS. 15(*a*) and 15(*b*), respectively. In this case, the frequency responses in the positions of the left and right ears of the listener 9 (shown in FIGS. 15(*a*) and 15(*b*), respectively) are akin to the frequency responses shown in FIGS. 11 (*a*) and 11(*b*), and this confirms that the reduction in the frequency components lower than 500 Hz is suppressed. Thereby, the degradation of the sound quality due to the sound image localization apparatus is suppressed.

As described above, by controlling the coefficients of the first multiplier 10*c*, the second multiplier 10*b*, and the third multiplier 10*a* in accordance with the desired angle of the virtual speaker 8 (desired second virtual sound image), i.e., the sound image localization angle input to the localization angle input device, the virtual speaker 8 can be localized in the position of the input angle. Further, the sound image localization angle input to the localization angle input device can be arbitrarily set in a range obtained by connecting the most distant two points amongst the following three points: the position in which the output from the first output unit 6*a* is emitted to space, the position in which the output from the second output unit 6*b* is emitted to space, and the predetermined position of the virtual speaker 8V (first virtual sound image).

In the prior art apparatus, the coefficients of the signal processing devices 5*a* and 5*b* must be changed to change the sound image of the virtual speaker 8, and usually filters of about 128 taps are used as the signal processing devices 5*a* and 5*b*. Assuming that the angle of the virtual speaker 8 is controlled at five points, when a filter of n taps is used in the prior art apparatus, the number of coefficients to be stored in the coefficient memory 4 is given by $$n*2*5=10n$$

On the other hand, in this second embodiment, the number of coefficients to be stored in the coefficient memory 4 is given by $$6(3\text{ multipliers}+3\text{ multipliers in the filter unit }\mathbf{11})*5+n*2=30+2n$$

whereby the required size of the coefficient memory 4 can be reduced to $$(30+2n)/10n=3/n+1/5$$

When the filter's tap number n is 128 as described above, a reduction of about 78% is realized. Further, by reproducing the audio signal while changing the multipliers 10*a*, 10*b*, and 10*c*, the sound image of the virtual speaker 8 can be easily moved.

In this case, the increment in computations is only product: number of arithmetic data*2

(because a multiplier is included in the filter unit 11)

sum of products: number of arithmetic data*4

(because an adder is included in the filter unit 11)

and this second embodiment can be realized with such a small increment in computations.

On the other hand, when a filter of n taps is used, the computations of the signal processing devices (5*a* and 5*b*) are given by product, sum of products: number of arithmetic data*2*n*

As the result, the increment in computations becomes 6/2n as compared with the prior art structure. When the filter's tap number n is 128 as described above, the increment in computations is only 2.2%, and this second embodiment can be realized with such a small increment in computations.

As described above, according to the second embodiment of the invention, the apparatus of the first embodiment further includes the filter unit 11 which receives the outputs from the coefficient control unit 3 and the input signal source 1, and the output from the filter unit 11 is input to the multipliers 10*a*, 10*b*, and 10*c*. Therefore, like the first embodiment of the invention, a sound image movable localization apparatus similar to the prior art apparatus can be realized with a very small increment in computations as compared with the computations in the prior art method and a coefficient memory of smaller capacity than that of the prior art apparatus. In addition, the variation in the integrated transfer characteristics of the signal processing section which comprises the multipliers 10*a*, 10*b*, and 10*c*, the signal processing devices 5*a* and 5*b*, and the adders 7*a* and 7*b*, can be compensated, whereby a sound image localization apparatus providing satisfactory sound quality is realized.

Embodiment 3

Figure 5:
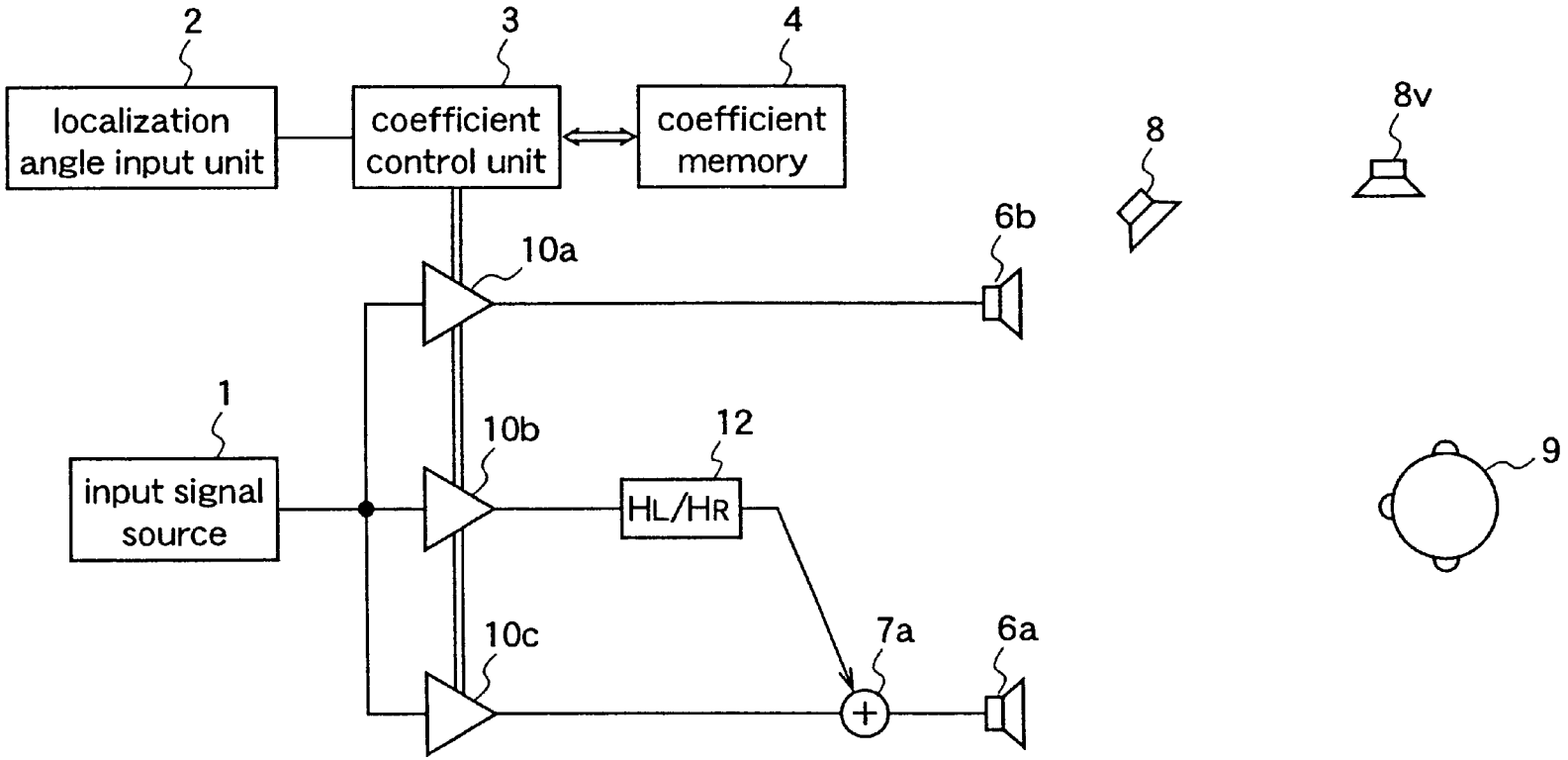
FIG. 5 is a block diagram illustrating the structure of a sound image localization apparatus according to a third embodiment of the present invention.

Hereinafter, a sound image localization apparatus according to a third embodiment of the present invention will be described with reference to figures. FIG. 5 is a block diagram illustrating the entire structure of the sound image localization apparatus of the third embodiment. In FIG. 5, the same reference numerals as those shown in FIG. 1 designate the same or corresponding parts. The sound image localization apparatus shown in FIG. 5 is different from the apparatus shown in FIG. 1 in that a signal processing device, 12 is provided instead of the first and second signal processing devices 5*a* and 5*b* connected to the second multiplier 10*b*, and the second adder 7*b* is removed.

Next, the operation of the sound image localization apparatus will be described. In FIG. 5, an analog-to-digital converted (PCM) audio signal is supplied from the signal source 1. This audio signal is input to the multipliers 10*a*, 10*b*, and 10*c*.

Further, angle information of the virtual speaker 8 is input to the localization angle input unit 2. The coefficient control unit 3 reads the coefficients for localizing the virtual speaker 8 from the coefficient memory 4 in accordance with the angle information supplied from the localization angle input unit 2, and sets the coefficients in the multipliers 10*a*, 10*b*, and 10*c*.

The output from the multiplier 10*b* is input to the signal processing device 12, and subjected to filtering with a predetermined frequency response. Now, the predetermined frequency response Of the signal processing device 12 will be described.

The above-described frequency response is for localizing a sound image in the position of the predetermined virtual speaker 8V (first virtual sound image) which is positioned diagonally to the front of the listener or on a side of the listener when the outputs which are obtained in the case where the coefficients of the first and second multipliers 10*c* and 10*b* are 1.0 and the coefficient of the third multiplier 10*a* is 0.0 are directly output from the first output unit 6*a* and the second output unit 6*b*, respectively, and the filter has the structure of an FIR filter as shown in FIG. 3. The predetermined frequency response of the signal processing device 12 is the frequency response of the filter for localizing the virtual sound image in the position of the virtual speaker 8V, and this filter has the structure of an FIR filter as shown in FIG. 3. An example of filter coefficients of this filter is shown in FIG. 20. This filter may be implemented by an IIR filter or an FIR+IIR hybrid filter. The method of computing the filter coefficients for localizing the virtual sound image in the position of the virtual speaker 8V is represented by $$G(n)=hL(n)/hR(n)$$

wherein hL(n) and hR(n) are the transfer characteristics obtained by replacing the transfer characteristics h5(n) and h6(n) with the transfer characteristics h7(n) and h8(n) in the position of the virtual speaker 8V in the prior art method, respectively.

The signal processed in the signal processing device 12 is added to the output of the multiplier 10*c* in the adder 7*a*, and the sum is converted to an analog signal and output from the output unit 6*a*. Further, the signal processed in the multiplier 10*a* is converted to an analog signal and output from the output unit 6*b*.

A description is now given of a method for controlling the coefficients of the multipliers 10*a*, 10*b*, and 10*c*.

When only the coefficient of the multiplier 10*a* is 1.0 and the coefficients of the multipliers 10*b* and 10*c* are 0.0, the input signal is output as it is to the output unit 6*b*. In this case, the sound image of the virtual speaker 8 is localized in the position of the output unit 6*b*. Likewise, when only the coefficient of the multiplier 10*c* is 1.0 and the coefficients of the multipliers 10*a* and 10*b* are 0.0, the input signal is output as, it is to the output unit 10*a*. In this case, the sound image of the virtual speaker 8 is localized in the position of the output unit 6*a*.

When the coefficients of the multipliers 10*a* and 10*b* are 1.0 and the coefficient of the multiplier 10*c* is 0.0, the input signal which has been processed in the multiplier 10*a* is output to the output unit 6*b*, and the input signal which has been filtered in the signal processing device 12 is output to the output unit 6*a*. In this case, the sound image of the virtual speaker 8 is localized in the position of the virtual speaker 8V.

When the coefficients of the multipliers 10*c* and 10*a* are 0.0 and 1.0, respectively, and the coefficient of the multiplier 10*b* is gradually decreased from 1.0, the position of the virtual speaker 8 is set at an angle between the output unit 6*b* and the virtual speaker 8V in accordance with the coefficient of the multiplier 10*b*. This ratio varies according to the predetermined frequency response of the signal processing device 12. As the coefficient of the multiplier 10*b* approaches 0.0, the position of the virtual speaker 8 gets closer to the position of the output unit 6*b*. Conversely, as the coefficient of the multiplier 10*b* approaches 1.0, the position of the virtual speaker 8 gets closer to the position of the virtual speaker 8V.

Furthermore, the virtual speaker 8 can be localized between the output unit 6*b* and the output unit 6*a* by setting the coefficient of the multiplier 10*b* to 0.0 and controlling the relative sizes of the coefficients of the multipliers 10*a* and 10*c*. In controlling the coefficients of the multipliers 10*a*, 10*b*, and 10*c* according to this third embodiment, the position of the virtual speaker 8 is decided according to the ratio of the multipliers 10*a*, 10*b*, and 10*c*. Hence, the values of the multipliers employed in this third embodiment are not restricted to 1.0 and the like.

As described above, by controlling the coefficients of the first multiplier 10*c*, the second multiplier 10*b*, and the third multiplier 10*a* in accordance with the desired angle of the virtual speaker 8 (desired second virtual sound image), i.e., the sound image localization angle input to the localization angle input device, the virtual speaker 8 (desired second virtual sound image) can be localized in the position of the input angle. Further, the sound image localization angle input to the localization angle input device can be arbitrarily set in a range obtained by connecting the most distant two points amongst the following three points: the position in which the output from the first output unit 6*a* is emitted to space, the position in which the output from the second output unit 6*b* is emitted to space, and the predetermined position of the virtual speaker 8V (first virtual sound image).

In the prior art apparatus, the coefficients of the signal processing devices 5*a* and 5*b* must be changed to change the sound image of the virtual speaker 8, and usually filters of about 128 taps are used as the signal processing devices 5*a* and 5*b*. Assuming that the angle of the virtual speaker 8 is controlled at five points, when a filter of n taps is used in the prior art apparatus, the number of coefficients to be stored in the coefficient memory 4 is given by $$n*2*5=10n$$

On the other hand, in this third embodiment, the number of coefficients to be stored in the coefficient memory 4 is given by $$3(\text{parameters of 3 multipliers})*5+n$$

whereby the required size of the coefficient memory 4 can be reduced to $$(15+n)/10n$$

When the filter's tap number n is 128 as described above, a reduction of about 89% is realized. Further, by reproducing the audio signal while changing the multipliers 10*a*, 10*b*, and 10*c*, the sound image of the virtual speaker 8 can be easily moved.

In this case, the increment in computations is as follows.

product: number of arithmetic data*1 sum of products: number of arithmetic data*2

When comparing the signal processing device 12 with the signal processing devices 5*a* and 5*b*, the decrement in computations is as follows.

sum of products: number of arithmetic data*n

On the other hand, when a filter of n taps is used, the computations of the signal processing devices (5*a* and 5*b*) are as follows.

product, sum of products: number of arithmetic data*2n

As the result, the increment in computations is (3−n)/2n, as compared with the computations in the prior art method.

When the filter's tap number n is 128, the computations are reduced by about 48%.

As described above, according to the third embodiment of the invention, a sound image movable localization apparatus similar to the prior art apparatus can be realized with the simpler structure than the apparatus of the first embodiment, about half of the computations in the prior art method, and a coefficient memory of smaller capacity than that of the prior art apparatus.

Embodiment 4

Figure 6:
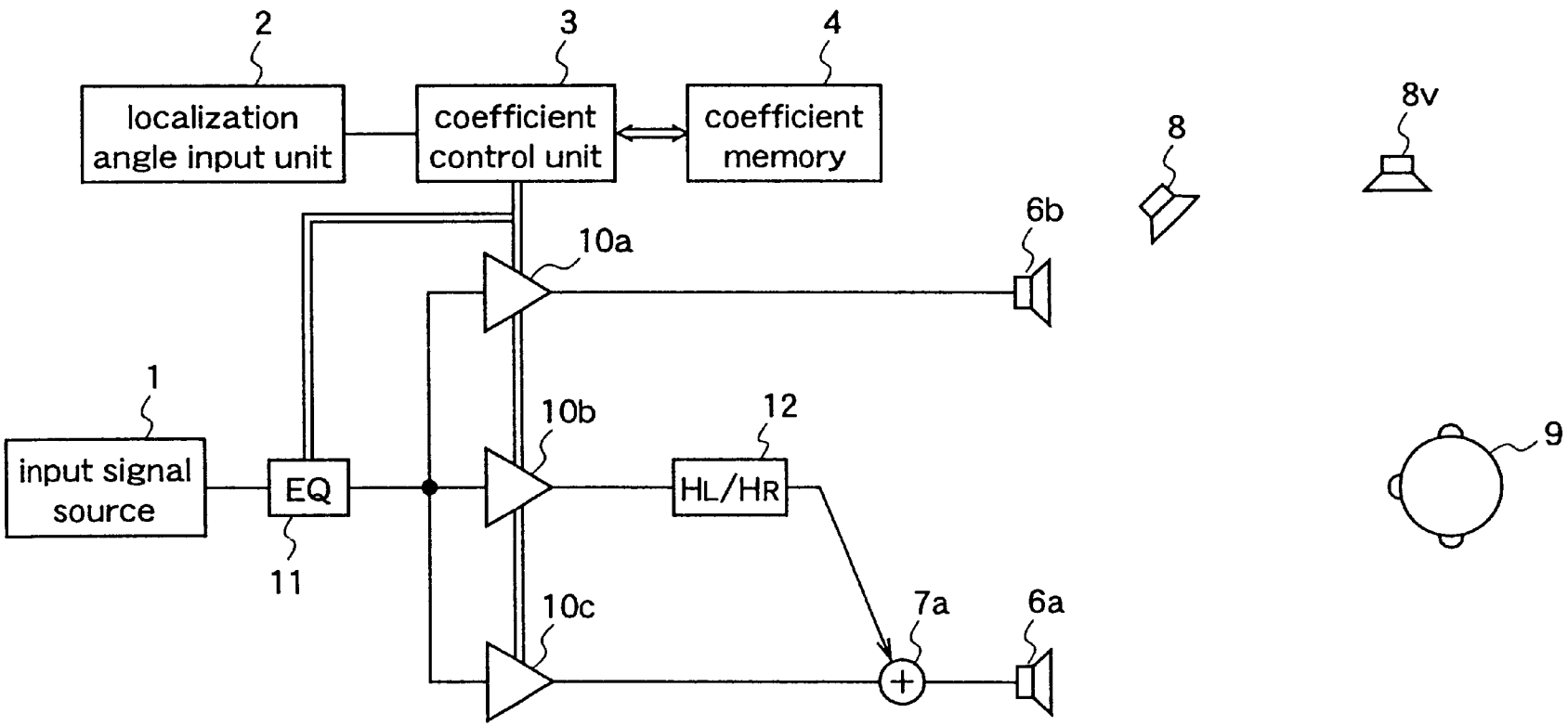
FIG. 6 is a block diagram illustrating the structure of a sound image localization apparatus according to a fourth embodiment of the present invention.

Hereinafter, a sound image localization apparatus according to a fourth embodiment of the present invention will be described with reference to figures. In the apparatus according to the third embodiment, the sound quality of the virtual speaker 8 sometimes varies because the integrated transfer characteristics of the signal processing section, which comprises the multipliers 10*a*~10*c*, the signal processing device 12, and the adder 7*a*, vary and, further, the output from the signal processing section has the frequency response of 1/Hr(n) as compared with that of the first embodiment. So, in this fourth embodiment, the sound image localization apparatus is provided with a device for compensating the variation in the integrated transfer characteristics of the signal processing section. FIG. 6 is a block diagram illustrating the entire structure of the sound image localization apparatus according to the fourth embodiment. In FIG. 6, the same reference numerals as those shown in FIG. 3 designate the same or corresponding parts. Reference numeral 11 designates a filter unit which receives the filter coefficients of the predetermined frequency response from the coefficient control unit 3 and processes the signal from the input signal source 1.

Next, the operation of the sound image localization apparatus will be described. In FIG. 6, angle information of the virtual speaker 8 is input to the localization angle input unit 2. The coefficient control unit 3 reads the coefficients for localizing the virtual speaker 8 from the coefficient memory 4 in accordance with the angle information from the localization angle input unit 2, and sets the coefficients in the filter unit 11 and the multipliers 10*a*, 10*b*, and 10*c*. The first multiplier 10*c*, the second multiplier 10*b*, and the third multiplier 10*a* multiplies, not the output signal from the input signal source 1, but the output from the filter unit 11, by using the first, second, and third coefficients from the coefficient control unit 3.

Further, an analog-to-digital converted (PCM) audio signal is supplied from the signal source 1. This audio signal is processed in the filter unit 11 with the predetermined frequency response, and the processed signal is input to the multipliers 10*a*~10*c*.

The output from the multiplier 10*b* is input to the signal processing device 12, and subjected to filtering with the predetermined frequency response. Hereinafter, the predetermined frequency response of the signal processing device 12 will be described.

The above-described frequency response is for localizing a sound image in the position of the predetermined virtual speaker 8V (first virtual sound image) which is positioned diagonally to the front of the listener or on a side of the listener, when the outputs of the first signal processing device 5*a* and the second signal processing device 5*b* are directly output from the first output unit 6*a* and the second output unit 6*b*, respectively, and the filter has the structure of an FIR filter as shown in FIG. 3. An example of filter coefficients of this filter is shown in FIG. 20. This filter can be implemented by an IIR filter or an FIR+IIR hybrid filter. The method of computing the filter coefficients for localizing the virtual sound image in the position of the virtual speaker 8V is represented by $$G(n)=hL(n)/hR(n)$$

wherein hL(n) and hR(n) are the transfer characteristics obtained by replacing the transfer characteristics h5(n) and h6(n) with the transfer characteristics h7(n) and h8(n) in the position of the virtual speaker 8V in the prior art method, respectively.

The signal processed in the signal processing device 12 is added to the output of the multiplier 10*a* in the adder 7*a*, and the sum is converted to an analog signal and output from the output unit 6*a*. Likewise, the signal processed in the multiplier 10*c* is converted to an analog signal and output from the output unit 6*b*.

Now, the method for controlling the coefficients of the multipliers 10*a*, 10*b*, and 10*c* will be described.

When only the coefficient of the multiplier 10*a* is 1.0 and the coefficients of the multipliers 10*b* and 10*c* are 0.0, the input signal is output as it is to the output unit 6*b*. In this case, the sound image of the virtual speaker 8 is localized in the position of the output unit 6*b*. Likewise, when only the coefficient of the multiplier 10*c* is 1.0 and the coefficients of the multipliers 10*a* and 10*b* are 0.0, the input signal is output as it is to the output unit 10*a*. In this case, the sound image of the virtual speaker 8 is localized in the position of the output unit 6*a*.

When the coefficients of the multipliers 10*a* and 10*b* are 1.0 and the coefficient of the multiplier 10*c* is 0.0, the input signal which has been processed in the multiplier 10*a* is output to the output unit 6*b*, and the input signal which has been filtered in the signal processing device 12 is output to the output unit 6*a*. In this case, the sound image of the virtual speaker 8 is localized in the position of the virtual speaker 8V.

When the coefficients of the multipliers 10*c* and 10*a* are 0.0 and 1.0, respectively, and the coefficient of the multiplier 10*b* is gradually decreased from 1.0, the position of the virtual speaker 8 is set at an angle between the output unit 6*b* and the virtual speaker 8V in accordance with the coefficient of the multiplier 10*b*. This ratio varies according to the predetermined frequency response of the signal processing device 12. As the coefficient of the multiplier 10*b* approaches 0.0, the position of the virtual speaker 8 gets closer to the position of the output unit 6*b*. Conversely, as the coefficient of the multiplier 10*b* approaches 1.0, the position of the virtual speaker 8 gets closer to the position of the virtual speaker 8V.

Furthermore, the virtual speaker 8 can be localized between the output unit 6*b* and the output unit 6*a* by setting the coefficient of the multiplier 10*b* to 0.0 and controlling the relative sizes of the coefficients of the multipliers 10*a* and 10*c*. In controlling the coefficients of the multipliers 10*a*, 10*b*, and 10*c* according to this fourth embodiment, the position of the virtual speaker 8 is decided according to the ratio of the multipliers 10*a*, 10*b*, and 10*c*. Hence, the values of the multipliers employed in this fourth embodiment are not restricted to 1.0 and the like.

Figure 16:
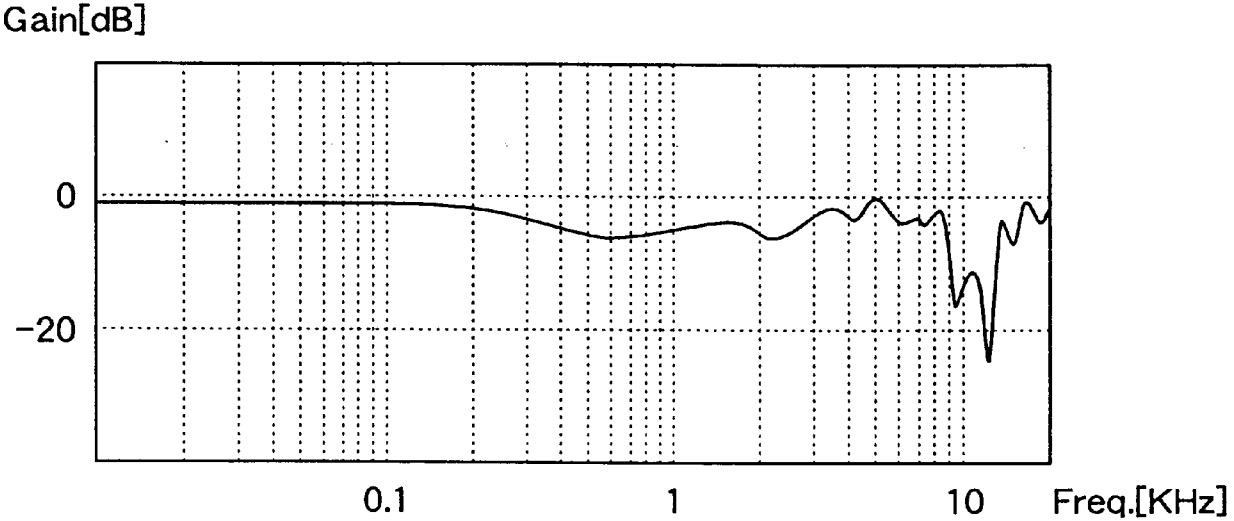
FIGS. 16(*a*) and 16(*b*) are diagrams illustrating the frequency responses, at both ears of the listener, of a sound from a virtual speaker 8V according to the fourth or eighth embodiment of the invention.
Figure 16:
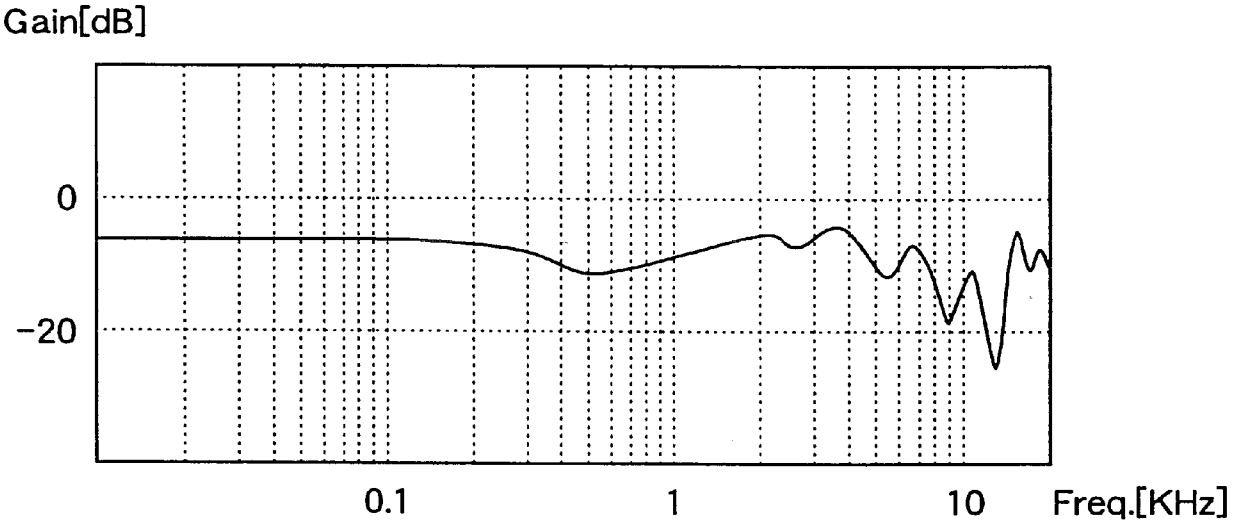
Figure 17:
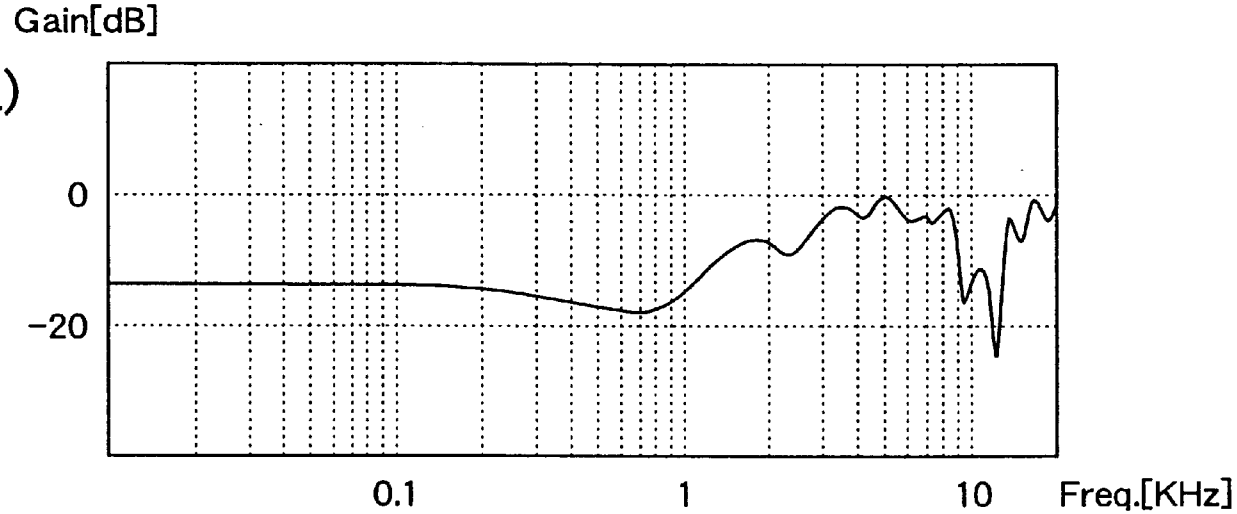
FIGS. 17(*a*) and 17(*b*) are diagrams illustrating the frequency responses, at both ears of the listener, of a sound from a virtual speaker according to the fourth or eighth embodiment of the invention.
Figure 17:
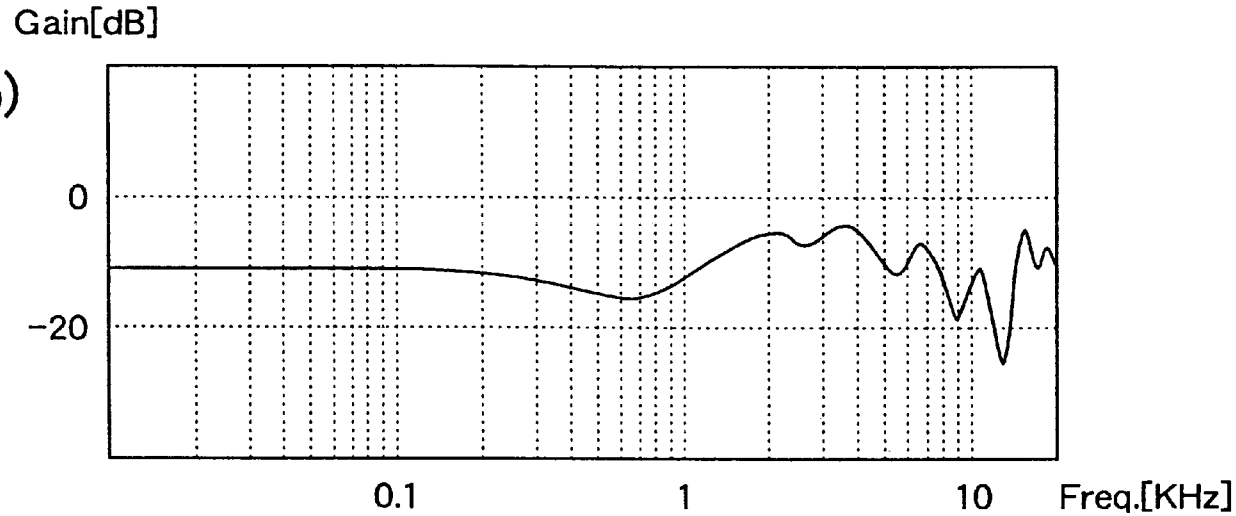

A description is now given of the integrated transfer characteristics of the signal processing section which comprises the multipliers 10*a*, 10*b*, and 10*c*, the signal processing device 12, and the adder 7*a*, in the case where the above-described sound image localization is carried out. When the coefficient of the multiplier 10*c* is 0.0 and the coefficients of the multipliers 10*a* and 10*b* are 1.0, the frequency responses of the virtual speaker 8 in the positions of the left and right ears of the listener 9 are shown in FIGS. 16(*a*) and 16(*b*). FIG. 16(*a*) shows the frequency response at the left ear of the listener 9, and FIG. 16(*b*) shows the frequency response at the right ear of the listener 9. When the coefficient of the multiplier 10*b* is set to 0.5, the frequency responses in the positions of the left and right ears of the listener 9 vary as shown in FIGS. 17(*a*) and 17(*b*). FIG. 17(*a*) shows the frequency response at the left ear of the listener 9, and FIG. 17(*b*) shows the frequency response at the right ear of the listener 9. When FIGS. 16(*a*) and 16(*b*) are compared with FIGS. 17(*a*) and 17(*b*), it can be seen that the frequency response of the virtual speaker, i.e., the sound quality, varies as the coefficients of the multipliers 10*a* and 10*b* vary. In this fourth embodiment, a reduction in frequency components lower than 500 Hz is detected, and it is thought that the sound quantity is degraded by this reduction.

So, this variation in the frequency response is compensated by using the filter unit 11. FIG. 13 is a block diagram illustrating an example of the structure of the filter unit 11.

This filter unit 11 is an IIR filter comprising two delay elements (D) 13*a* and 13*b*, three multipliers 14*a*, 14*b*, and 14*c*, and an adder 15. The input terminal of the filter unit 11 and the output ends of the delay elements 13*a* and 13*b* are connected to the multipliers 14*a*, 14*b*, and 14*c*, respectively, and the outputs of these multipliers are added in the adder 15. Although in this fourth embodiment a first order IIR filter is used, the filter unit 11 is not restricted thereto. For example, an FIR filter, an n-th order IIR filter, or an FIR+IIR filter may be used. However, the computational complexity may vary according to the structure of the filter unit 11. Furthermore, the filter coefficients of the predetermined frequency response of the filter unit 11 compensate at least one of the sound quality, the change in sound volume, the phase characteristics, and the delay characteristics, amongst the frequency responses of the signal processing section which comprise the first multiplier 10*c*, the second multiplier 10*b*, the third multiplier 10*a*, the signal processing device 12, and the adder 7*a*.

Figure 18:
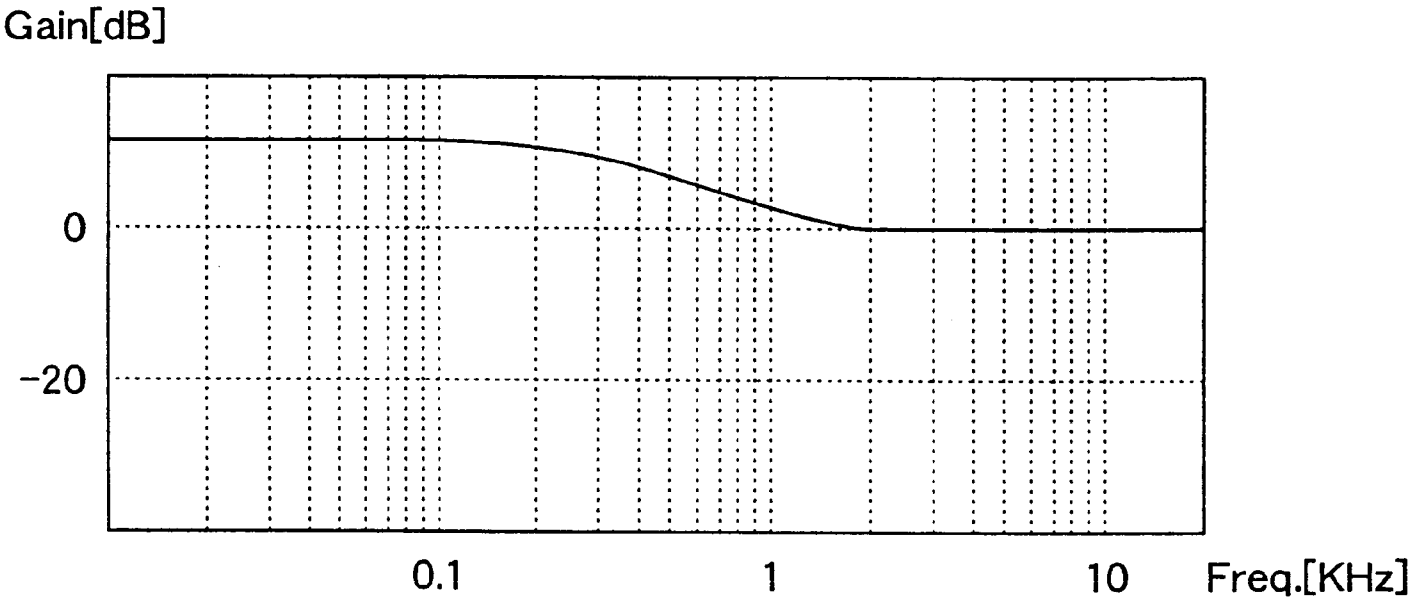
FIG. 18 is a diagram illustrating the frequency response of the filter unit according to the fourth or eighth embodiment of the invention.
Figure 19:
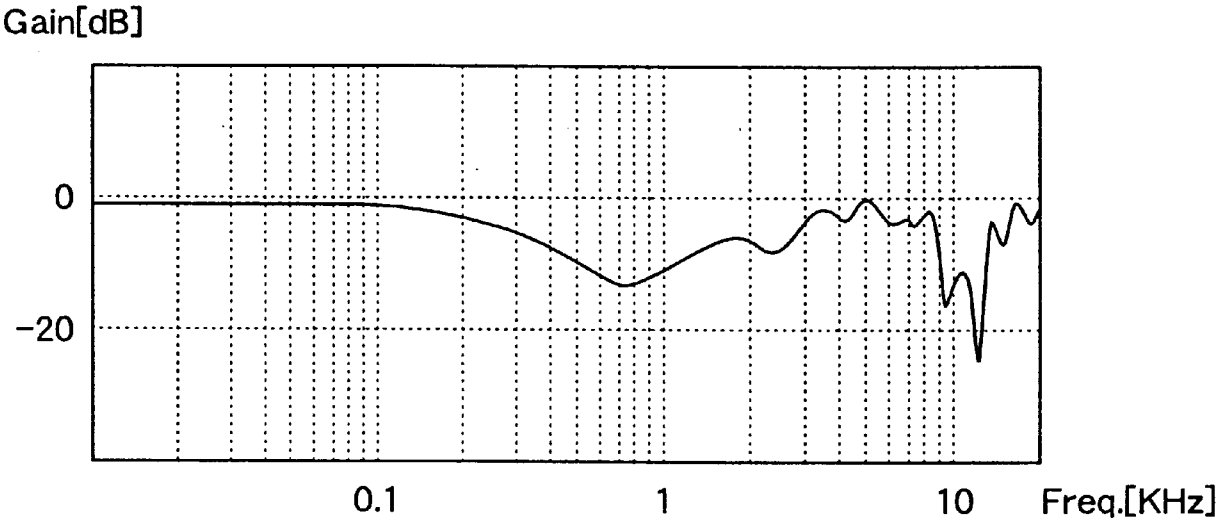
FIGS. 19(*a*) and 19(*b*) are diagrams illustrating the frequency responses, at both ears of the listener, of a sound from a virtual speaker 8 when it is compensated in the filter unit according to the fourth or eighth embodiment of the invention.
Figure 19:
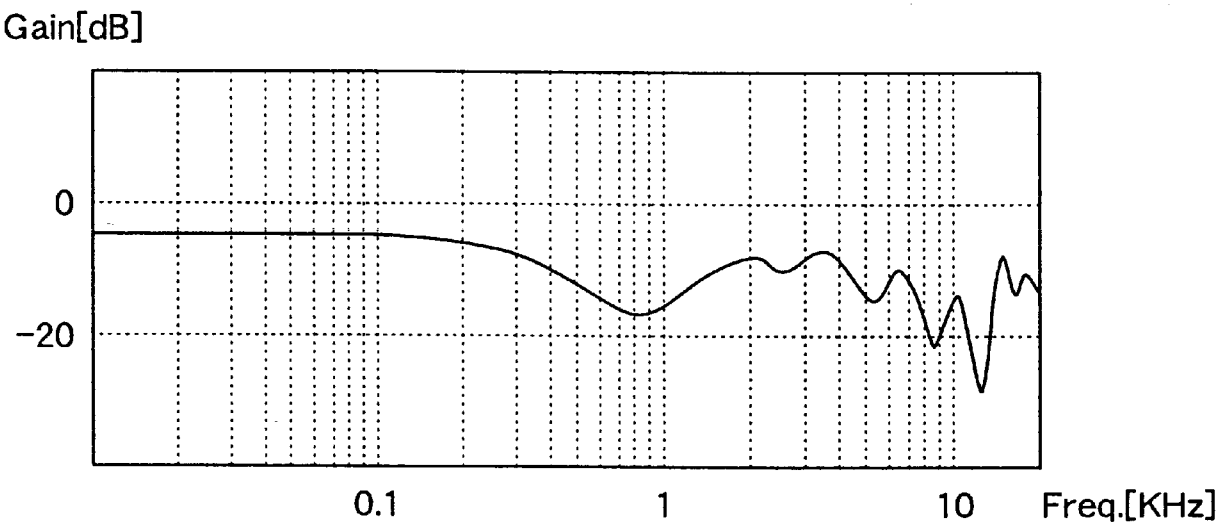

FIG. 18 shows an example of frequency response of the filter unit 11. When the frequency response of the input signal is compensated by the frequency response of the filter unit 11 and the coefficients of the multipliers 10*a* and 10*b* are set to 0.5, the frequency responses in the positions of the left and right ears of the listener 9 become as shown in FIGS. 19(*a*) and 19(*b*), respectively. In this case, the frequency responses in the positions of the left and right ears of the listener 9 (shown in FIGS. 19(*a*) and 19(*b*), respectively) are akin to the frequency responses shown in FIGS. 16(*a*) and 16(*b*), and this confirms that the reduction in the frequency components lower than 500 Hz is suppressed. Thereby, the degradation in sound quality due to the sound image localization apparatus is suppressed.

As described above, by controlling the coefficients of the first multiplier 10*c*, the second multiplier 10*b*, and the third multiplier 10*a* in accordance with the desired angle of the virtual speaker 8 (desired second virtual sound image), i.e., the sound image localization angle input to the localization angle input device, the virtual speaker 8 (desired second virtual sound image) can be localized in the position of the input angle. Further, the sound image localization angle input to the localization angle input device can be arbitrarily set in a range obtained by connecting the most distant two points amongst the following three points: the position in which the output from the first output unit 6*a* is emitted to space, the position in which the output from the second output unit 6*b* is emitted to space, and the predetermined position of the virtual speaker 8V (first virtual sound image).

In the prior art apparatus, the coefficients of the signal processing devices 5*a* and 5*b* must be changed to change the sound image of the virtual speaker 8, and usually filters of about 128 taps are used as the signal processing devices 5*a* and 5*b*. Assuming that the angle of the virtual speaker 8 is controlled at five points, when a filter of n taps is used in the prior art apparatus, the number of coefficients to be stored in the coefficient memory 4 is given by $$n*2*5=10n$$

On the other hand, in this fourth embodiment, the number of coefficients to be stored in the coefficient memory 4 is given by $$6*5+n=30+n$$

whereby the required size of the coefficient memory 4 can be reduced to $$(30+n)/10n=3/2n+1/10$$

When the filter's tap number n is 128, a reduction of about 88% is realized. Further, by reproducing the audio signal while changing the multipliers 10*a*, 10*b*, and 10*c*, the sound image of the virtual speaker 8 can be easily moved.

In this case, the increment in computations is as follows.

product: number of arithmetic data*2 sum of products: number of arithmetic data*4

Further, when the signal processing device 12 is compared with the signal process devices 5*a* and 5*b*, the decrement in computations is as follows.

sum of products: number of arithmetic data*n

On the other hand, when a filter of n taps is used, the computations of the signal processing devices 5*a* and 5*b* are as follows.

product, sum of products: number of arithmetic data*2n

As the result, the increment in computations is (6−n)/2n, as compared with the computations in the prior art method. When the filter's tap number n is 128, the computations are reduced by about 46%.

As described above, according to the fourth embodiment of the invention, a sound image movable localization apparatus similar to the prior art apparatus can be realized with about half of the computations in the prior art method, and a coefficient memory of smaller capacity than that of the prior art apparatus. Furthermore, since the variation in the integrated transfer characteristics of the signal processing section is compensated, a sound image localization apparatus providing satisfactory sound quality can be realized.

Embodiment 5

Figure 7:
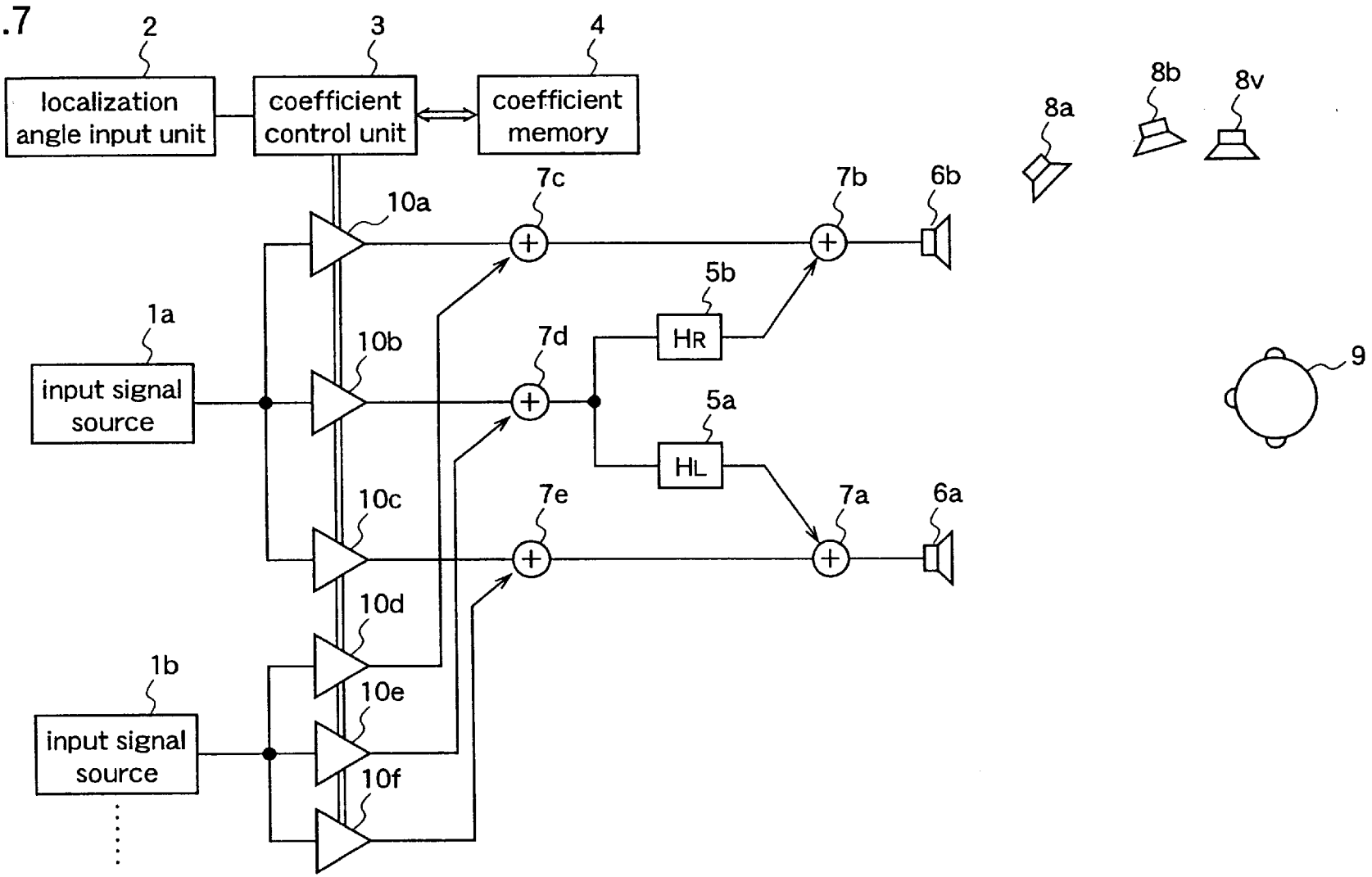
FIG. 7 is a block diagram illustrating the structure of a sound image localization apparatus according to a fifth embodiment of the present invention.

Hereinafter, a sound image localization apparatus according to a fifth embodiment of the invention will be described with reference to figures. The sound image localization apparatus of this fifth embodiment has the construction to cope with the case where a plurality of input signal sources are provided in the apparatus of the first embodiment. FIG. 7 is a block diagram illustrating the entire structure of the sound image localization apparatus according to this fifth embodiment. In FIG. 7, the same reference numerals as those shown in FIG. 1 designate the same or corresponding parts. In the sound image localization apparatus shown in FIG. 7, assuming that a section comprising the input signal source 1*a*, the first multiplier 10*c*, the second multiplier 10*b*, the third multiplier 10*a*, the first signal processing device 5*a*, the second signal processing device 5*b*, the fourth adder 7*a*, the fifth adder 7*b*, the first output unit 6*a*, the second output unit 6*b*, the localization angle input unit 2, the coefficient control unit 3, and the coefficient memory 4, is regarded as a first apparatus, this first apparatus has the same structure as the sound image localization apparatus of the first embodiment.

Likewise, assuming that a section comprising the input signal source 1*b*, the first multiplier 10*f*, the second multiplier 10*e*, the third multiplier 10*d*, the first signal processing device 5*a*, the second signal processing device 5*b*, the fourth adder 7*a*, the fifth adder 7*b*, the first output unit 6*a*, the second output unit 6*b*, the localization angle input unit 2, the coefficient control unit 3, and the coefficient memory 4, is regarded as a second apparatus, this second apparatus also has the same structure as the sound image localization apparatus of the first embodiment.

In this fifth embodiment, as shown in FIG. 7, the output unit 6*a* is positioned on the forward-left to the front of the listener 9, the output unit 6*b* is positioned on the forward-right of the listener 9, the virtual speakers 8*a* and 8*b* are positioned diagonally to the front of the listener 9, and the virtual speaker 8V is positioned on the right side of the listener 9.

Next, the operation of the sound image localization apparatus will be described. In FIG. 7, two kinds of analog-to-digital converted (PCM) audio signals are supplied from the input signal sources 1*a* and 1*b*, respectively. The audio signal supplied from the signal source 1*a* is input to the multipliers 10*a*~10*c* while the audio signal supplied from the signal source 1*b* is input to the *multipliers 10*d*~10*f*.

Further, two kinds of angle information of the virtual speakers 8*a* and 8*b* are input to the localization angle input unit 2. The coefficient control unit 3 reads the coefficients for localizing the virtual speakers 8*a* and 8*b* from the coefficient memory 4 in accordance with the angle information from the localization angle input unit 2. The coefficient control unit 3 sets the coefficients for localizing the virtual speaker 8*a* in the multipliers 10*a*~10*c*, and sets the coefficients for localizing the virtual speaker 8*b* in the multipliers 10*d*~10*f*.

The output from the multiplier 10*b* is added to the output of the multiplier 10*e* in the adder 7*d*, and the sum is subjected to filtering in the signal processing devices 5*a* and 5*b*. The predetermined frequency responses of the signal processing devices 5*a* and 5*b* are identical to those described for the first embodiment.

Further, the output from the multiplier 10*a* is added to the output of the multiplier 10*d* in the adder 7*c*. Likewise, the output of the multiplier 10*c* is added to the output of the multiplier 10*f* in the adder 7*e*.

The signal processed in the signal processing device 5*b* is added to the output of the adder 7*c* in the adder 7*b*, and the sum is converted to an analog signal and output from the output unit 6*b*. Further, the signal processed in the signal processing device 5*a* is added to the output of the adder 7*e* in the adder 7*a*, and the sum is converted to an analog signal and output from the output unit 6*b*.

A description is now given of the control method for localizing the virtual speakers 8*a* and 8*b* in positions between the output unit 6*a* and the virtual speaker 8V.

The localization method for the virtual speaker 8*a* is realized by controlling the multipliers 10*a*, 10*b*, and 10*c* as described for the first embodiment. In an ordinary sound image localization apparatus, when localizing two or more sound images, two sets of sound image localization apparatuses are constructed and the outputs from the output units are added in the output stage. In the sound image localization apparatus of this fifth embodiment, however, it is possible to realize plural virtual speakers of different angles, by controlling the coefficients of the multipliers according to the angles of the virtual speakers, without changing the predetermined frequency responses of the signal processing devices 5*a* and 5*b*. Hence, the computations for the second and subsequent channels can be reduced by unifying the signal processing device whose frequency responses need not be changed. In this fifth embodiment, the signal processing device for the virtual speaker 8*b* and the signal processing device for the virtual speaker 8*a* are unified. Further, the angle of the virtual speaker 8*b* can be arbitrarily set between the output unit 6*a* and the virtual speaker 8V by controlling the coefficients of the multipliers 10*d*~10*f*.

As described above, by controlling the coefficients of the first multiplier 10*c*, the second multiplier 10*b*, the third multiplier 10*a*, the first multiplier 10*f*, the second multiplier 10*e*, and the third multiplier 10*d* in accordance with the desired angles of the virtual speakers 8*a* and 8*b* (desired second virtual sound images), i.e., the sound image localization angle input to the localization angle input device, the virtual speakers 8*a* and 8*b* (desired second virtual sound image) can be localized in the positions of the input angles. Further, the sound image localization angle input to the localization angle input device can be arbitrarily set in a range obtained by connecting the most distant two points amongst the following three points: the position in which the output from the first output unit 6*a* is emitted to space, the position in which the output from the second output unit 6*b* is emitted to space, and the predetermined position of the virtual speaker 8V (first virtual sound image). Therefore, even in the case where a plurality of virtual speakers are provided, a sound image localization apparatus capable of localizing plural sound images and moving the sound images can be realized with reduced computations and a coefficient memory of smaller capacity as compared with those of the prior art apparatus.

Embodiment 6

Figure 8:
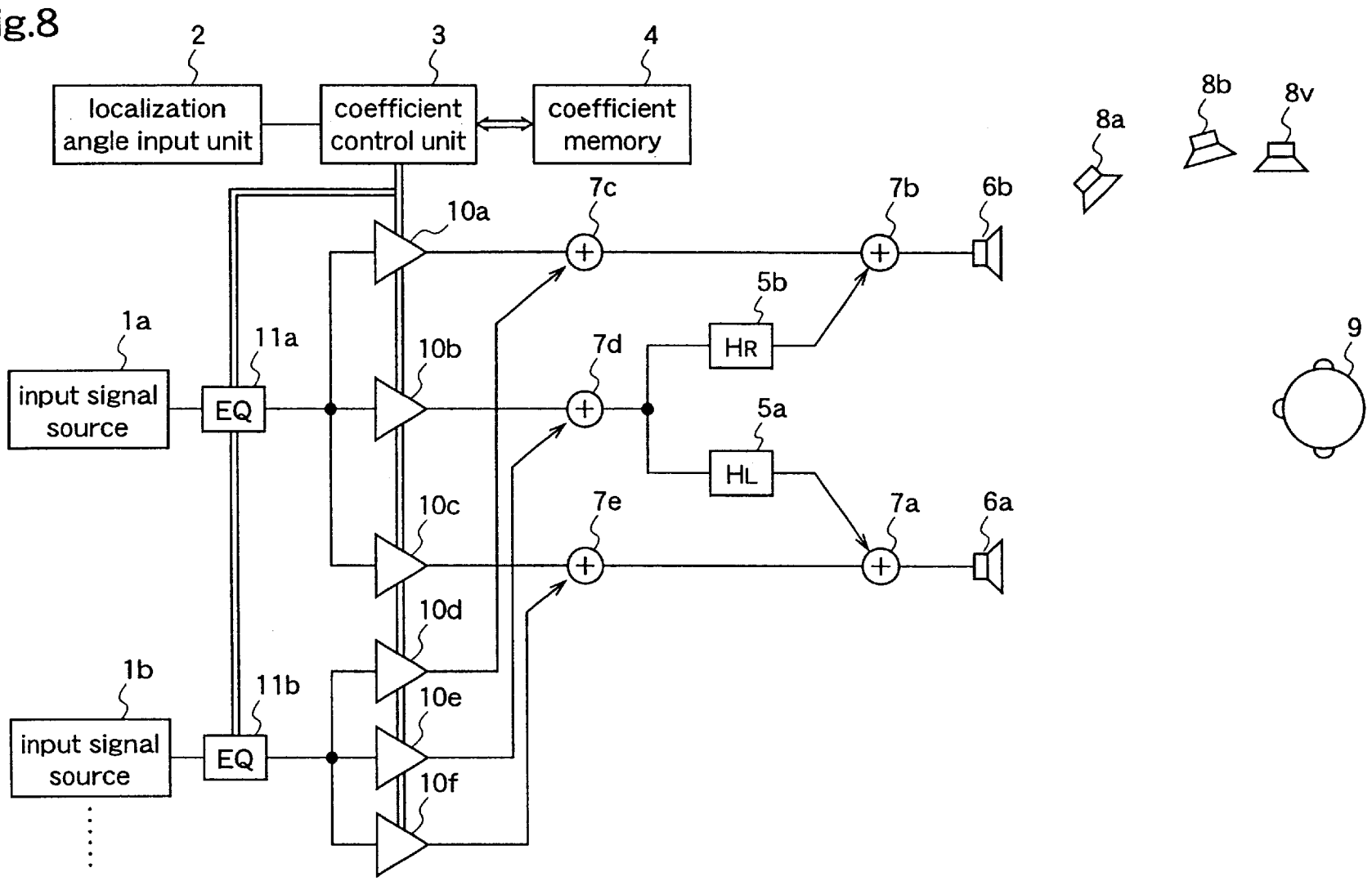
FIG. 8 is a block diagram illustrating the structure of a sound image localization apparatus according to a sixth embodiment of the present invention.

Hereinafter, a sound image localization apparatus according to a sixth embodiment of the invention will be described with reference to figures. Also in the localization method of the fifth embodiment, the sound quality of the virtual speaker 8 (desired second virtual sound image) sometimes varies according to the coefficients of the multipliers, as described for the second embodiment. So, the sound image localization apparatus of this sixth embodiment is provided with a device for compensating the variation in the integrated transfer characteristics of the signal processing section. FIG. 8 is a block diagram illustrating the entire structure of the sound image localization apparatus according to this sixth embodiment. In FIG. 8, the same reference numerals as those shown in FIGS. 4 and 7 designate the same or corresponding parts. The apparatus shown in FIG. 8 includes, in addition to the constituents of the apparatus shown in FIG. 7, a filter unit 11*a* which receives the output from the coefficient control unit 3 and the signal from the input signal source 1*a*, and a filter unit 11*b* which receives the output of the coefficient control unit 3 and the signal from the input signal source 1*b*.

In the sound image localization apparatus shown in FIG. 8, assuming that a section comprising the input signal source 1*a*, the filter unit 11*a*, the first multiplier 10*c*, the second multiplier 10*b*, the third multiplier 10*a*, the first signal processing device 5*a*, the second signal processing device 5*b*, the fourth adder 7*a*, the fifth adder 7*b*, the first output unit 6*a*, the second output unit 6*b*, the localization angle input unit 2, the coefficient control unit 3, and the coefficient memory 4, is regarded as a first apparatus, this first apparatus has the same structure as the sound image localization apparatus of the second embodiment.

Likewise, assuming that a section comprising the input signal source 1*b*, the filter unit 11*b*, the first multiplier 10*f*, the second multiplier 10e, the third multiplier 10*d*, the first signal processing device 5*a*, the second signal processing device 5*b*, the fourth adder 7*a*, the fifth adder 7*b*, the first output unit 6*a*, the second output unit 6*b*, the localization angle input unit 2, the coefficient control unit 3, and the coefficient memory 4, is regarded as a second apparatus, this second apparatus also has the same structure as the sound image localization apparatus of the second embodiment.

Next, the operation of the sound image localization apparatus will be described. In FIG. 8, two kinds of analog to-digital converted (PCM) audio signals are supplied from the input signal sources 1*a* and 1*b*, respectively. The audio signal supplied from the signal source 1*a* is input to the multipliers 10*a*~10*c* while the audio signal supplied from the signal source 1*b* is input to the multipliers 10*d*~10*f*. The first multiplier 10*c*, the second multiplier 10*b*, and the third multiplier 10*a* multiply, not the output signal from the input signal source 1*a*, but the output from the filter unit 11*a*, by using the first, second, and third coefficients from the coefficient control unit 3. Likewise, the first multiplier 10*f*, the second multiplier 10*e*, and the third multiplier 10*d* multiply not the output signal from the input signal source 1*b*, but the output from the filter unit 11*b*, by using the first, second, and third coefficients from the coefficient control unit 3.

Further, two kinds of angle information of the virtual speakers 8*a* and 8*b* are input to the localization angle input unit 2. The coefficient control unit 3 reads the coefficients for localizing the virtual speakers 8*a* and 8*b* from the coefficient memory 4 in accordance with the angle information from the localization angle input unit 2. The coefficient control unit 3 sets the coefficients for localizing the virtual speaker 8*a* in the multipliers 10*a*~10*c*, and sets the coefficients for localizing the virtual speaker 8*b* in the multipliers 10*d*~10*f*. Furthermore, the coefficient control unit 3 sets the coefficients of the filter units 11*a* and 11*b*.

The output from the multiplier 10*b* is added to the output from the multiplier 10*e* in the adder 7*d*, and the sum is subjected to filtering in the signal processing devices 5*a* and 5*b*. The predetermined frequency responses of the signal processing devices 5*a* and 5*b* are identical to those described for the first embodiment.

Further, the output from the multiplier 10*a* is added to the output from the multiplier 10*d* in the adder 7*c*. Likewise, the output from the multiplier 10*c* is added to the output from the multiplier 10*f* in the adder 7*e*.

The signal processed in the signal processing device 5*b* is added to the output from the adder 7*c* in the adder 7*b*, and the sum is converted to an analog signal and output from the output unit 6*b*. Further, the signal processed in the signal processing device 5*a* is added to the output from the adder 7*e* in the adder 7*a*, and the sum is converted to an analog signal and output from the output unit 6*a*.

A description is now given of the control method for localizing the virtual speakers 8*a* and 8*b* in positions between the output unit 6*a* and the virtual speaker 8V.

The localization method for the virtual speaker 8*a* is realized by controlling the multipliers 10*a*, 10*b*, and 10*c* as described for the first embodiment. In an ordinary sound image localization apparatus, when localizing two or more sound images, two sets of sound image localization apparatuses are constructed and the outputs from the output units are added in the output stage. In the sound image localization apparatus of this sixth embodiment, however, it is possible to realize plural virtual speakers of different angles, by controlling the coefficients of the multipliers according to the angles of the virtual speakers, without changing the predetermined frequency responses of the signal processing devices 5*a* and 5*b*. So, the computations for the second and subsequent channels can be reduced by unifying the signal processing device whose frequency responses need not be changed. In this sixth embodiment, the signal processing device for the virtual speaker 8*b* and the signal processing device for the virtual speaker 8*a* are unified. Further, the angle of the virtual speaker 8*b* can be arbitrarily set between the output unit 6*a* and the virtual speaker 8V by controlling the coefficients of the multipliers 10*d*~10*f*.

In the sound image localization apparatus of this sixth embodiment, as described for the second embodiment, the sound qualities of the virtual speakers 8*a* and 8*b* vary according to the coefficients of the multipliers in each of the first and second apparatuses. These variations are compensated by using the filter units 11*a* and 11*b*. Thereby, satisfactory sound quality can be maintained even when the angles of the virtual speakers 8*a* and 8*b* are changed.

As described above, by controlling the coefficients of the first multiplier 10*c*, the second multiplier 10*b*, the third multiplier 10*a*, the first multiplier 10*f*, the second multiplier 10*e*, and the third multiplier 10*d* in accordance with the desired angles of the virtual speakers 8*a* and 8*b* (desired second virtual sound images), i.e., the sound image localization angle input to the localization angle input device, the virtual speakers 8*a* and 8*b* (desired second virtual sound image) can be localized in the positions of the input angles. Further, the: sound image localization angle input to the localization angle input device can be arbitrarily set in a range obtained by connecting the most distant two points amongst the following three points: the position in which the output from the first output unit 6*a* is emitted to space, the position in which the output from the second output unit 6*b* is emitted to space, and the predetermined position of the virtual speaker 8V (first virtual sound image). Therefore, even in the case where a plurality of virtual speakers are provided, a sound image localization apparatus capable of localizing plural sound images and moving the sound images, can be realized with reduced computations and a coefficient memory of smaller capacity as compared with those of the prior art apparatus.

Therefore, even in the case where a plurality of virtual speakers are provided, a sound image localization apparatus capable of localizing plural sound images and moving these sound images, which is similar to the conventional apparatus, can be realized with reduced computations and a coefficient memory of smaller capacity as compared with those of the prior art apparatus. Further, since the variation in the integrated transfer characteristics of the signal processing section is compensated, a sound image localization apparatus providing satisfactory sound quality can be realized.

Embodiment 7

Figure 9:
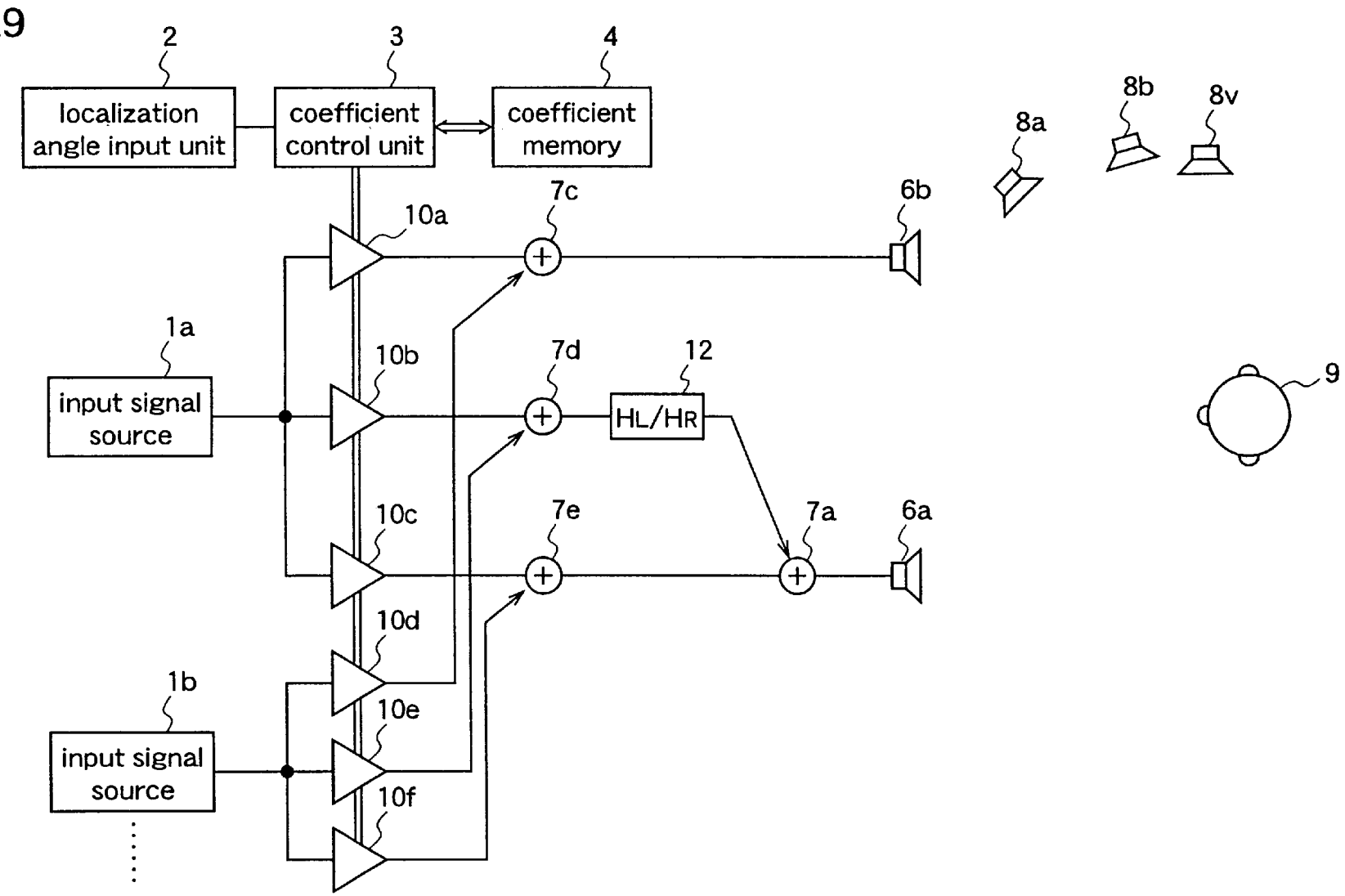
FIG. 9 is a block diagram illustrating the structure of a sound image localization apparatus according to a seventh embodiment of the present invention.

Hereinafter, a sound image localization apparatus according to a seventh embodiment of the invention will be described with reference to figures. The sound image localization apparatus of this seventh embodiment has the construction to cope with the case where a plurality of input signal sources are provided in the structure of the third embodiment. FIG. 9 is a block diagram illustrating the entire structure of the sound image localization apparatus of this seventh embodiment. In FIG. 9, the same reference numerals as those shown in FIG. 5 designate the same or corresponding parts. In the sound image localization apparatus shown in FIG. 9, assuming that a section comprising the input signal source 1*a*, the first multiplier 10*c*, the second multiplier 10*b*, the third multiplier 10*a*, the signal processing device 12, the fourth adder 7*a*, the first output unit 6*a*, the second output unit 6*b*, the localization angle input unit 2, the coefficient control unit 3, and the coefficient memory 4, is regarded as a first apparatus, this first apparatus has the same structure as the sound image localization apparatus of the third embodiment.

Likewise, assuming that a section comprising the input signal source 1*b*, the first multiplier the second multiplier 10*e*, the third multiplier 10*d*, the signal processing device 12, the fourth adder 7*a*, the first output unit 6*a*, the second output unit 6*b*, the localization angle input unit 2, the coefficient control unit 3, and the coefficient memory 4, is regarded as a second apparatus, this second apparatus also has the same structure as the third image localization apparatus of the first embodiment.

Next, the operation of the sound image localization apparatus will be described. With reference to FIG. 9, two kinds of analog-to-digital converted (PCM) audio signals are supplied from the input signal sources 1*a* and 1*b*, respectively. The audio signal supplied from the signal source 1*a* is input to the multipliers 10*a*~10*c* while the audio signal supplied from he signal source 1*b* is input to the multipliers 10*d*~10*f*.

Further, two kinds of angle information of the virtual speakers 8*a* and 8*b* (desired second virtual sound images) are input to the localization angle input unit 2. The coefficient control unit 3 reads the coefficients for localizing the virtual speakers 8*a* and 8*b* from the coefficient memory 4 according to the angle information from the localization angle input unit 2. The coefficient control unit 3 sets the coefficients for localizing the virtual speaker 8*a* in the multipliers 10*a*~10*c*, and sets the coefficients for localizing the virtual speaker 8*b* in the multipliers 10*d*~10*f*.

The output from the multiplier 10*b* is added to the output from the multiplier 10*e* in the adder 7*d*, and the sum is subjected to filtering in the signal processing device 12. The predetermined frequency response of the signal processing device 12 are identical to those described for the third embodiment.

Further, the output from the multiplier 10*a* is added to the output from the multiplier 10*d* in the adder 7*c*. Likewise, the output from the multiplier 10*c* is added to the output from the multiplier 10*f* in the adder 7*e*.

The output from the adder 7*c* is converted to an analog signal in the output unit 6*b* and then output from the unit 6*b*. Further, the signal processed by the signal processing device 12 is added to the output from the adder 7*e* in the adder 7*a*, and the sum is converted to an analog signal and output from the output unit 6*a*.

A description is now given of the control method for localizing the virtual speakers 8*a* and 8*b* in positions between the output unit 6*a* and the virtual speaker 8V.

The localization method for the virtual speaker 8*a* can be realized by controlling the multipliers 10*a*, 10*b*, and 10*c* as described for the first embodiment. In an ordinary sound image localization apparatus, when localizing two or more sound images, two sets of sound image localization apparatuses are constructed and the outputs from the respective output units are added in the output stage. In the sound image localization apparatus of this seventh embodiment, however, it is possible to realize plural virtual speakers of different angles by controlling the coefficients of the multipliers according to the angles of the virtual speakers without changing the predetermined frequency response of the signal processing device 12. So, the computations for the second and subsequent channels can be reduced by unifying the signal processing device whose frequency responses need not be changed. In this seventh embodiment, the signal processing device for the virtual speaker 8*b* and the signal processing device for the virtual speaker 8*a* are unified. Further, the angle of the virtual speaker 8*b* can be arbitrarily set between the output unit 6*a* and the virtual speaker 8V by controlling the coefficients of the multipliers 10*d*~10*f*.

As described above, by controlling the coefficients of the first multiplier 10*c*, the second multiplier 10*b*, the third multiplier 10*a*, the first multiplier 10*f*, the second multiplier 10*e*, and the third multiplier 10*d* in accordance with the desired angles of the virtual speakers 8*a* and 8*b* (desired second virtual sound images), i.e., the sound image localization angle input to the localization angle input device, the virtual speakers 8*a* and 8*b* (desired second virtual sound image) can be localized in the positions of the input angles. Further, the sound image localization angle input to the localization angle input device can be arbitrarily set in a range obtained by connecting the most distant two points amongst the following three points: the position in which the output from the first output unit 6*a* is emitted to space, the position in which the output from the second output unit 6*b* is emitted to space, and the predetermined position of the virtual speaker 8V (first virtual sound image).

Therefore, even in the case where a plurality of virtual speakers are provided, a sound image localization apparatus capable of localizing plural sound images and moving these sound images, which is similar to the conventional apparatus, can be realized with the simpler construction than that of the first embodiment, reduced computations as compared with those in the prior art method, and a coefficient memory of smaller capacity than that of the prior art apparatus.

Embodiment 8

Figure 10:
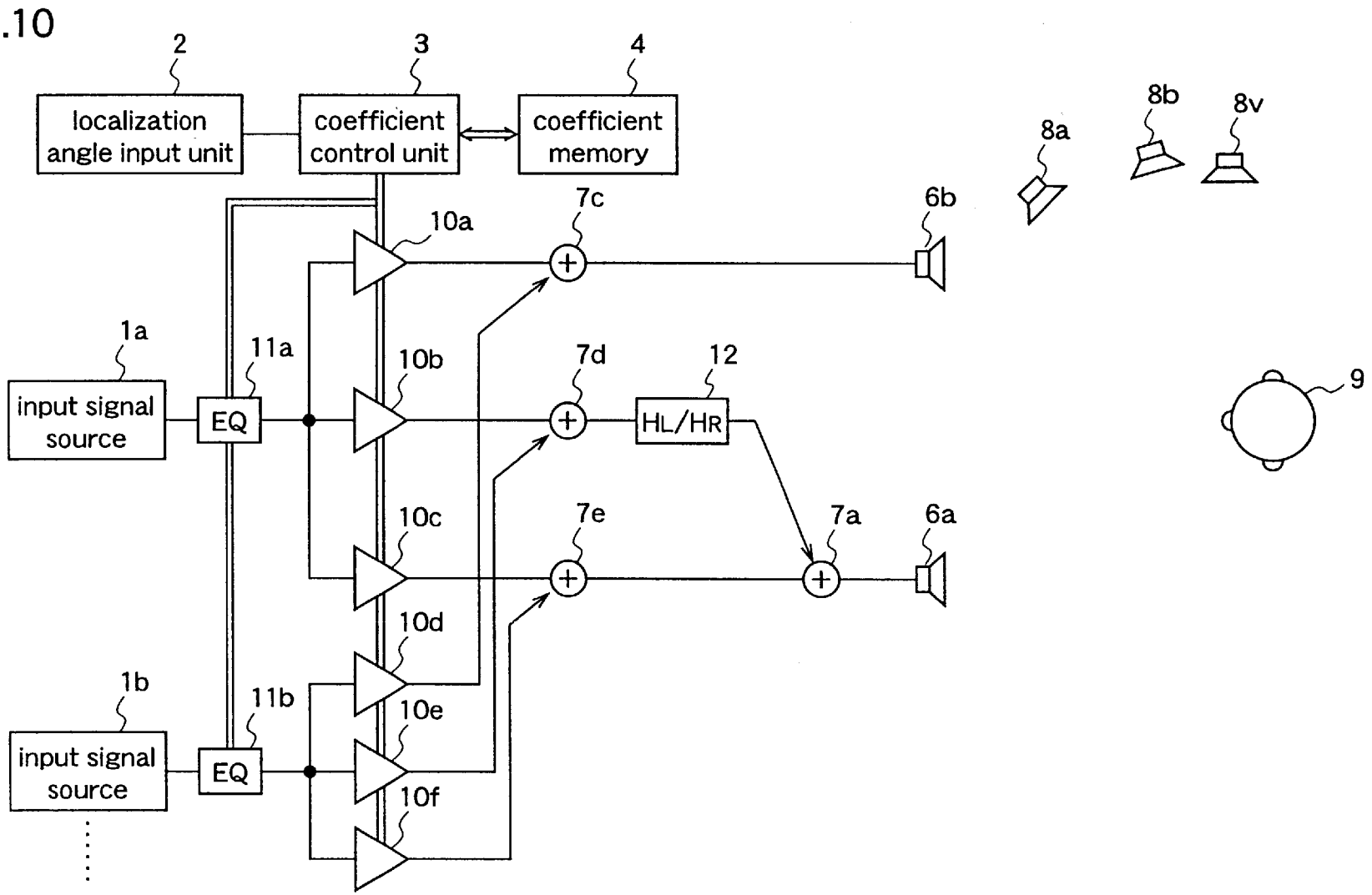
FIG. 10 is a block diagram illustrating the structure of a sound image localization apparatus according to an eighth embodiment of the present invention.

Hereinafter, a sound image localization apparatus according to an eighth embodiment of the invention will be described with reference to figures. In the apparatus of the seventh embodiment, as described for the second embodiment, the sound quality of the virtual speaker 8 sometimes varies according to the coefficients of the multipliers. So, the sound image localization apparatus of this eighth embodiment is provided with a device for compensating the variation in the integrated transfer characteristics of the signal processing section. FIG. 10 is a block diagram illustrating the entire structure of the sound image localization apparatus according to this eighth embodiment. In FIG. 10, the same reference numerals as those shown in FIGS. 6 and 9 designate the same or corresponding parts. The apparatus shown in FIG. 10 includes, in addition to the constituents of the apparatus shown in FIG. 9, a filter unit 11*a* which receives the output from the coefficient control unit 3 and the signal from the input signal source 1*a*, and a filter unit 11*b* which receives the output of the coefficient control unit 3 and the signal from the input signal source 1*b*.

In the sound image localization apparatus shown in FIG. 10, assuming that a section comprising the input signal source 1*a*, the filter unit 11*a*, the first multiplier 10*c*, the second multiplier 10*b*, the third multiplier 10*a*, the signal processing device 12, the fourth adder 7*a*, the first output unit 6*a*, the second output unit 6*b*, the localization angle input unit 2, the coefficient control unit 3, and the coefficient memory 4, is regarded as a first apparatus, this first apparatus has the same structure as the sound image localization apparatus of the fourth embodiment.

Likewise, assuming that a section comprising the input signal source 1*b*, the filter unit 11*b*, the first multiplier 10*f*, the second multiplier 10*e*, the third multiplier 10*d*, the signal processing device 12, the fourth adder 7*a*, the first output unit 6*a*, the second output unit 6*b*, the localization angle input unit 2, the coefficient control unit 3, and the coefficient memory 4, is regarded as a second apparatus, this second apparatus also has the same structure as the sound image localization apparatus of the fourth embodiment.

Next, the operation of the sound image localization apparatus will be described. In FIG. 10, two kinds of analog-to-digital converted (PCM) audio signals are supplied from the input signal sources 1*a* and 1*b*, respectively. The audio signal supplied from the signal source 1*a* is input to the multipliers 10*a*~10*c* while the audio signal supplied from the signal source 1*b* is input to the multipliers 10*d*~10*f*. The first multiplier 10*c*, the second multiplier 10*b*, and the third multiplier 10*a* multiply not the output signal from the input signal source 1*a*, but the output from the filter unit 11*a*, by using the first, second, and third coefficients from the coefficient control unit 3. Likewise, the first multiplier 10*f*, the second multiplier 10*e*, and the third multiplier 10*d* multiply not the output signal from the input signal source 1*b*, but the output from the filter unit 11*b*, by using the first, second, and third coefficients from the coefficient control unit 3.

Further, two kinds of angle information of the virtual speakers 8*a* and 8*b* (desired second virtual sound images) are input to the localization angle input unit 2. The coefficient control unit 3 reads the coefficients for localizing the virtual speakers 8*a* and 8*b* from the coefficient memory 4 in accordance with the angle information from the localization angle input unit 2. The coefficient control unit 3 sets the coefficients for localizing the virtual speaker 8*a* in the third multiplier 10*a*, the second multiplier 10*b*, and the first multiplier 10*c*. Further, the coefficient control unit 3 sets the coefficients for localizing the virtual speaker 8*b* in the third multiplier 10*d*, the second multiplier 10*e*, and the first multiplier 10*f*. Moreover, the coefficient control unit 3 receives the filter coefficients of the predetermined frequency response, and sets the coefficients in the filter units 11*a* and 11*b* which process the signal from the input signal source 1.

The output from the multiplier 10*b* is added to the output from the multiplier 10*e* in the adder 7*d*, and the sum is subjected to filtering in the signal processing device 12. The predetermined frequency response of the signal processing device 12 is identical to that described for the fourth embodiment.

Further, the output from the multiplier 10*a* is added to the output from the multiplier 10*d* in the adder 7*c*. Likewise, the output from the multiplier 10*c* is added to the output from the multiplier 10*f* in the adder 7*e*.

Further, the output from the adder 7*c* is converted to an analog signal in the output unit 6*b* and then output from the unit 6*b*. The signal processed in the signal processing device 12 is added to the output from the adder 7*e* in the adder 7*a*, and the sum is converted to an analog signal and output from the output unit 6*a*.

A description is now given of the control method for localizing the virtual speakers 8*a* and 8*b* in positions between the output unit 6*a* and the virtual speaker 8V.

The localization method for the virtual speaker 8*a* is realized by controlling the multipliers 10*a*, 10*b*, and 10*c* as described for the first embodiment. In an ordinary sound image localization apparatus, when localizing two or more sound images, two sets of sound image localization apparatuses are constructed and the outputs from the respective output units are added in the output stage. In the sound image localization apparatus of this eighth embodiment, however, it is possible tax to realize plural virtual speakers of different angles, by controlling the coefficients of the multipliers according to the angles of the virtual speakers, without changing the predetermined frequency response of the signal processing a device 12. So, the computations for the second and subsequent channels can be reduced by unifying the signal processing a device whose frequency responses need not be changed. In this eighth embodiment, the signal processing a device for the virtual speaker 8*b* and the signal processing a device for the virtual speaker 8*a* are unified. Further, the angle of the virtual speaker 8*b* can be arbitrarily set between the output unit 6*a* and the virtual speaker 8V by controlling the coefficients of the multipliers 10*d* 10*f*.

In the sound image localization apparatus so constructed, as described for the second embodiment, the sound qualities or the virtual speakers 8*a* and 8*b* vary according to the coefficients of the multipliers in each of the first and second apparatuses. These variations are compensated by using the filter units 11*a* and 11*b*. Thereby, satisfactory sound quality can be maintained even when the angles of the virtual speakers 8*a* and 8*b* are changed.

As described above, by controlling the coefficients of the filter units 11*a* and 11*b*, the first multiplier 10*c*, the second multiplier 10*b*, the third multiplier 10*a*, the first multiplier 10*f*, the second multiplier 10*e*, and the third multiplier 10*d* in accordance with the desired angles of the virtual speakers 8*a* and 8*b* (desired second virtual sound images), i.e., the sound image localization angle input to the localization angle input a device, the virtual speakers 8*a* and 8*b* (desired second virtual sound image) can be localized in the positions of the input angles. Further, the sound image localization angle input to the localization angle input a device can be arbitrarily set in a range obtained by connecting the most distant two points amongst the following three points: the position in which the output from the first output unit 6*a* is emitted to space, the position in which the output from the second output unit 6*b* is emitted to space, and the predetermined position of the virtual speaker 8V (first virtual sound image).

Thereby, even in the case where a plurality of virtual speakers are provided, a sound image localization apparatus capable of localizing plural sound images and moving these sound images, which is similar to the conventional apparatus, can be realized with the simpler construction than that of the first embodiment, reduced computations as compared with those in the prior art method, and a coefficient memory of smaller capacity than that of the prior art apparatus. Further, since the variation in the integrated transfer characteristics of the signal processing section is compensated, a sound image localization apparatus providing satisfactory sound quality can be realized.

What is claimed is:

1. A sound image localization apparatus comprising:

a signal source operable to output an audio signal;

a localization angle input device operable to receive an angle of a sound image to be localized;

a coefficient control device operable to receive sound image localization angle information from said localization angle input device, read coefficients from a coefficient memory in accordance with the sound image localization angle information, and output the coefficients;

first, second, and third multipliers operable to multiply the audio signal output from said signal source by using first, second, and third coefficients output from said coefficient control device, respectively, and output the products;

a first signal processing device operable to receive the output from said second multiplier, and process it by using a filter having a predetermined first frequency response;

a second signal processing device operable to receive the output from said second multiplier, and process it by using a filter having a predetermined second frequency response;

a first adder operable to receive the output from said first multiplier and the output from said first signal processing device, and add these outputs to output the sum;

a second adder operable to receive the output from said third multiplier and the output from said second signal processing device, and add these outputs to output the sum;

a first output unit operable to output the output of said first adder; and a second output unit operable to output the output of said second adder.

2. The sound image localization apparatus of claim 1, wherein:

the predetermined first and second frequency responses are for localizing a first virtual sound image in a predetermined position diagonal to the front of a listener or on a side of the listener when the outputs of said first and second signal processing devices are directly output from said first and second output units;

the coefficients of said first, second, and third multipliers are varied according to the sound image localization angle which is input to said localization angle input device, whereby a desired second virtual sound image is localized in a position of the input angle; and the sound image localization angle input to said localization angle input device can be arbitrarily set within a range obtained by connecting the most distant two positions amongst the following three positions: a position at which the output from said first output unit is emitted to space, a position at which the output from said second output unit is emitted to space, and the predetermined position of the first virtual sound image.

3. The sound image localization apparatus of claim 1, further comprising:

a filter device operable to receive filter coefficients of the predetermined frequency responses from said coefficient control device, and process the signal from said signal source; and said first, second, and third multipliers are operable to multiply, instead of the output signal from said signal source, the output from said filter device by using the first, second, and third coefficients from said coefficient control device, respectively.

4. The sound image localization apparatus of claim 3, wherein:

the predetermined first and second frequency responses are for localizing a first virtual sound image in a predetermined position diagonal to the front of a listener or on a side of the listener when the outputs of said first and second signal processing devices are directly output from said first and second output units;

the coefficients of said first, second, and third multipliers are varied according to said localization angle input device, whereby a desired second virtual sound image is localized in a position of the angle input to said localization angle input device; and the sound image localization angle to be input to said localization angle input device can be arbitrarily set within a range obtained by connecting the most distant two positions amongst the following three positions: a position at which the output from said first output unit is emitted to space, a position at which the output from said second output unit is emitted to space, and the predetermined position of the first virtual sound image.

5. The sound image localization apparatus of claim 3, wherein the filter coefficients of the frequency response of said filter device compensate at least one of a sound quality, a change in sound volume, phase characteristics, and delay characteristics amongst the frequency responses of a signal processing section which comprises said first, second, and third multipliers, said first and second signal processing devices, and said first and second adders.

6. A sound image localization method for use with the sound image localization apparatus of claim 3, said sound image localization method comprising:

deciding the position of the desired virtual sound image to be input to the localization angle input device by controlling a ratio of the coefficients of the respective multipliers in accordance with a distance from the nearest two positions amongst the following three positions: the position of the first output unit disposed on the left of a listener, the position of the second output unit placed on the right of the listener, and the position of a virtual sound image realized by using filters having the predetermined first and second frequency responses;

emphasizing the coefficient of the first multiplier in order to bring the position of the desired virtual sound image close to the first output unit;

emphasizing the coefficient of the third multiplier in order to bring the position of the desired virtual sound image close to the second output unit; and emphasizing the coefficient of the second multiplier in order to bring the position of the desired virtual sound image close to the virtual sound image realized by using the filters.

7. A sound image localization method for use with the sound image localization apparatus of claim 3, said sound localization method comprising:

setting the coefficients of the filter device according to the input from the localization angle input device so as to compensate at least one of a change in sound volume, a change in phase characteristics, and a change in delay characteristics depending on the change in the frequency response of the sound image or the change in the position of the sound image caused by the change in the coefficients of the first, second, and third multipliers.

8. A sound image localization method for use with the sound image localization apparatus of claim 1, said sound image localization method comprising:

deciding the position of the desired virtual sound image to be input to the localization angle input device by controlling a ratio of the coefficients of the respective multipliers in accordance with a distance from the nearest two positions amongst the following three positions: the position of the first output unit disposed on the left of a listener, the position of the second output unit placed on the right of the listener, and the position of a virtual sound image realized by using filters having the predetermined first and second frequency responses;

emphasizing the coefficient of the first multiplier in order to bring the position of the desired virtual sound image close to the first output unit;

emphasizing the coefficient of the third multiplier in order to bring the position of the desired virtual sound image close to the second output unit; and emphasizing the coefficient of the second multiplier in order to bring the position of the desired virtual sound image close to the virtual sound image realized by using the filters.

9. A sound image localization apparatus comprising:

a signal source operable to output an audio signal;

a localization angle input device operable to receive an angle of a sound image to be localized;

a coefficient control device operable to receive sound image localization angle information from said localization angle input device, read coefficients from a coefficient memory in accordance with the sound image localization angle information, and output the coefficients;

first, second, and third multipliers operable to multiply the audio signal output from said signal source by using first, second, and third coefficients output from said coefficient control device, respectively, and output the products;

a signal processing device operable to receive the output from said second multiplier, and process it by using a filter having a predetermined frequency response;

an adder operable to receive the output from said third multiplier and the output from said signal processing device, and add these outputs to output the sum;

a first output unit operable to output the output of said first multiplier; and a second output unit operable to output the output of the adder.

10. The sound image localization apparatus of claim 9, wherein the predetermined frequency response possessed by said signal processing device are for localizing a first virtual sound image in a predetermined position diagonal to the front of a listener or on a side of the listener when the outputs which are obtained in the case where the coefficients of said first and second multipliers are 1.0 and the coefficient of said third multiplier is 0.0 are output directly from said first and second output units, respectively;

the coefficients of said first, second, and third multipliers are varied according to the sound image localization angle input to said localization angle input device, whereby a desired second virtual sound image is localized in a position of the input angle; and the sound image localization angle input to said localization angle input device can be arbitrarily set within a range obtained by connecting the most distant two positions amongst the following three positions: a position at which the output of said first output unit is emitted to space, a position at which the output of said second output unit is emitted to space, and the predetermined position of the first virtual sound image.

11. The sound image localization apparatus of claim 9, further comprising:

a filter device operable to receive filter coefficients of the frequency response from said coefficient control device, and process the signal output from said signal source;

said first, second, and third multipliers are operable to multiply, instead of the output signal from said signal source, the output from said filter device by using the first, second, and third coefficients from said coefficient control device, respectively.

12. The sound image localization apparatus of claim 11, wherein the predetermined frequency response possessed by said signal processing device are for localizing a first virtual sound image in a predetermined position diagonal to the front of a listener or on a side of the listener when the outputs which are obtained in the case where the coefficients of said first and second multipliers are 1.0 and the coefficient of said third multiplier is 0.0 are output directly from said first and second output units, respectively;

the coefficients of said first, second and third multipliers are varied according to the sound image localization angle input to said localization angle input device, whereby a desired second virtual sound image is localized in a position of the input angle; and the sound image localization angle input to said localization angle input device can be arbitrarily set within a range obtained by connecting the most distant two positions amongst the following three positions: a position at which the output of said first output unit is emitted to space, a position at which the output of said second output unit is emitted to space, and the predetermined position of the first virtual sound image.

13. The sound image localization apparatus of claim 11, wherein the filter coefficients of the predetermined frequency response of said filter device compensate at least one of a sound quality, a change in sound volume, phase characteristics, and delay characteristics amongst the frequency responses of a signal processing section which comprises said first, second, and third multipliers, said signal processing device, and said adder.

14. A sound image localization method for use with the sound image localization apparatus of claim 11, said sound image localization method comprising:

deciding the position of the desired virtual sound image to be input to the localization angle input device by controlling the ratio of the coefficients of the respective multipliers according to the distance from the nearest two positions amongst the following three positions: the position of the first output unit disposed on the left of a listener, the position of the second output unit disposed on the right of the listener, and the position of the virtual sound image realized by using the filter having the predetermined frequency response;

decreasing the coefficient of the second multiplier in order to bring the desired virtual sound image close to the first output unit;

emphasizing the coefficient of the third multiplier in order to bring the desired virtual sound image close to the second output unit; and emphasizing the coefficient of the second multiplier in order to bring the desired virtual sound image close to the virtual sound image realized by using the filter.

15. A sound image localization method for use with the sound image localization apparatus of claim 11, said sound localization method comprising:

setting the coefficients of the filter device according to the input from the localization angle input device so as to compensate at least one of a change in sound volume, a change in phase characteristics, and a change in delay characteristics depending on the change in the frequency response of the sound image or the change in the position of the sound image caused by the change in the coefficients of the first, second, and third multipliers.

16. A sound image localization method for use with the sound image localization apparatus of claim 9, said sound image localization method comprising:

deciding the position of the desired virtual sound image to be input to the localization angle input device by controlling the ratio of the coefficients of the respective multipliers according to the distance from the nearest two positions amongst the following three positions: the position of the first output unit disposed on the left of a listener, the position of the second output unit disposed on the right of the listener, and the position of the virtual sound image realized by using the filter having the predetermined frequency response;

decreasing the coefficient of the second multiplier in order to bring the desired virtual sound image close to the first output unit;

emphasizing the coefficient of the third multiplier in order to bring the desired virtual sound image close to the second output unit; and emphasizing the coefficient of the second multiplier in order to bring the desired virtual sound image close to the virtual sound image realized by using the filter.

17. A sound image localization apparatus comprising:

a plurality of signal sources operable to output audio signals;

a localization angle input device operable to receive an angle of a sound image to be localized;

a coefficient control device operable to receive sound image localization angle information from said localization angle input device, read coefficients from a coefficient memory in accordance with the sound image localization angle information, and output the coefficients;

a plurality of signal input units provided correspondingly to said plurality of signal sources, each of said plurality of signal input units having first, second, and third multipliers operable to multiply the audio signal output from the corresponding one of said plurality of signal sources by using first, second, and third coefficients from said coefficient control device, respectively, and output the products;

a first adder operable to sum all of the outputs from said first multipliers of said plurality of signal input units;

a second adder operable to sum all of the outputs from said second multipliers of said plurality of signal input units;

a third adder operable to sum all of the outputs from said third multipliers of said plurality of signal input units;

a first signal processing device operable to receive the output from said second adder, and process it by using a filter having a predetermined first frequency response;

a second signal processing device operable to receive the output from said second adder, and process it by using a filter having a predetermined second frequency response;

a fourth adder operable to receive the output from said first adder and the output from said first signal processing device, and add these signals to output the sum;

a fifth adder operable to receive the output from said third multiplier and the output from said second signal processing device, and add these signals to output the sum;

a first output unit operable to output the output of said fourth adder; and a second output unit operable to output the output of said fifth adder.

18. The sound image localization apparatus of claim 17, wherein:

the predetermined first and second frequency responses are for localizing a first virtual sound image in a predetermined position diagonal to the front of a listener or on a side of the listener when the outputs of said first and second signal processing devices are directly output from said first and second output units;

plural pieces of sound image localization information of the same number as the input units are input to said localization angle input device;

the coefficients of said first, second, and third multipliers in each input unit are varied according to the sound image localization angle input to said localization angle input device, whereby a desired virtual sound image is localized in a position of each input angle; and the sound image localization angle input to said localization angle input device can be arbitrarily set within a range obtained by connecting the most distant two positions amongst the following three positions: a position at which the output of said first output unit is emitted to space, a position at which the output of said second output unit is emitted to space, and the predetermined position of the first virtual sound image.

19. The sound image localization apparatus of claim 17, further comprising:

a filter device, provided correspondingly to each of said signal sources, operable to receive filter coefficients of the predetermined frequency responses from said coefficient control device, and process the signal output from said signal source; and said first, second, and third multipliers operable to multiply, instead of the output signal from said signal source, the output from said filter device by using the first, second, and third coefficients from said coefficient control device, respectively.

20. The sound image localization apparatus of claim 19, wherein:

the predetermined first and second frequency responses are for localizing a first virtual sound image in a predetermined position diagonal to the front of a listener or on a side of the listener when the outputs of said first and second signal processing devices are directly output from said first and second output units;

plural pieces of sound image localization information of the same number as said plurality of signal input units are input to said localization angle input device, and the coefficients of said first, second, and third multipliers of each of said plurality of signal input units are varied according to the sound image localization information, whereby a desired virtual sound image is localized in a position of each input angle; and the sound image localization angle input to said localization angle input device can be arbitrarily set within a range obtained by connecting the most distant two positions amongst the following three positions: a position at which the output of said first output unit is emitted to space, a position at which the output of said second output unit is emitted to space, and the predetermined position of the first virtual sound image.

21. The sound image localization apparatus of claim 19, wherein the filter coefficients of the predetermined frequency response of said filter device compensate at least one of a sound quality, a change in sound volume, phase characteristics, and delay characteristics amongst the frequency responses of a signal processing section which comprises said first, second, and third multipliers of said input unit, said first and second signal processing devices, and said fourth and fifth adders.

22. A sound image localization method for use with the sound image localization apparatus of claim 19, said sound image localization method comprising:

deciding the position of the desired virtual sound image to be input to the localization angle input device by controlling a ratio of the coefficients of the respective multipliers in accordance with a distance from the nearest two positions amongst the following three positions: the position of the first output unit disposed on the left of a listener, the position of the second output unit placed on the right of the listener, and the position of a virtual sound image realized by using filters having the predetermined first and second frequency responses;

emphasizing the coefficient of the first multiplier in order to bring the position of the desired virtual sound image close to the first output unit;

emphasizing the coefficient of the third multiplier in order to bring the position of the desired virtual sound image close to the second output unit; and emphasizing the coefficient of the second multiplier in order to bring the position of the desired virtual sound image close to the virtual sound image realized by using the filters.

23. A sound image localization method for use with the sound image localization apparatus of claim 19, said sound localization method comprising:

setting the coefficients of the filter device according to the input from the localization angle input device so as to compensate at least one of a change in sound volume, a change in phase characteristics, and a change in delay characteristics depending on the change in the frequency response of the sound image or the change in the position of the sound image caused by the change in the coefficients of the first, second, and third multipliers.

24. A sound image localization method for use with the sound image localization apparatus of claim 17, said sound image localization method comprising:

deciding the position of the desired virtual sound image to be input to the localization angle input device by controlling a ratio of the coefficients of the respective multipliers in accordance with a distance from the nearest two positions amongst the following three positions: the position of the first output unit disposed on the left of a listener, the position of the second output unit placed on the right of the listener, and the position of a virtual sound image realized by using filters having the predetermined first and second frequency responses;

emphasizing the coefficient of the first multiplier in order to bring the position of the desired virtual sound image close to the first output unit;

emphasizing the coefficient of the third multiplier in order to bring the position of the desired virtual sound image close to the second output unit; and emphasizing the coefficient of the second multiplier in order to bring the position of the desired virtual sound image close to the virtual sound image realized by using the filters.

25. A sound image localization apparatus comprising:

a plurality of signal sources operable to output audio signals;

a localization angle input device operable to receive an angle of a sound image to be localized;

a coefficient control device operable to receive sound image localization angle information from said localization angle input device, read coefficients from a coefficient memory in accordance with the sound image localization angle information, and output the coefficients;

signal input units provided corresponding to said plurality of signal sources, each of said input units having first, second, and third multipliers operable to multiply the audio signal output from corresponding one of said plurality of signal sources by using first, second, and third coefficients output from said coefficient control device, respectively, and output the products;

a first adder operable to sum all of the outputs from said first multipliers of said signal input units;

a second adder operable to sum all of the outputs from said second multipliers of said signal input units;

a third adder operable to sum all of the outputs from said third multipliers of said signal input units;

a signal processing device operable to receive the output from said second adder, and process it by using a filter having a predetermined frequency response;

a fourth adder operable to receive the output from said third multiplier and the output from said signal processing device, and add these signals to output the sum;

a first output unit operable to output the output of said first adder; and a second output unit operable to output the output of said fourth adder.

26. The sound image localization apparatus of claim 25, wherein:

the predetermined frequency response is for localizing a first virtual sound image in a predetermined position diagonal to the front of a listener or on a side of the listener when the outputs which are obtained in the case where the coefficients of said first and second multipliers are 1.0 and the coefficient of said third multiplier is 0.0 are output directly from said first and second output units, respectively;

plural pieces of sound image information of the same number as said signal input units are input to said localization angle input device;

the coefficients of said first, second, and third multipliers of each of said signal input units are varied according to the sound image localization angle input to said localization angle input device, whereby a desired virtual sound image is localized in a position of each input angle; and the sound image localization angle to be input to said localization angle input device can be arbitrarily set within a range obtained by connecting the most distant two positions amongst the following three positions: a position at which the output of said first output unit is emitted to space, a position at which the output of said second output unit is emitted to space, and the predetermined position of the first virtual sound image.

27. The sound image localization apparatus of claim 25, further comprising:

filter devices, provided correspondingly to each of said signal sources, operable to receive the filter coefficients of the predetermined frequency response from said coefficient control device, and process the audio signal output from the corresponding signal source; and said first, second, and third multipliers operable to multiply, instead of the output signal from said signal source, the output from each of said filter devices, by using the first, second, and third coefficients from said coefficient control devices, respectively.

28. The sound image localization apparatus of claim 27, wherein:

the predetermined frequency response is for localizing a first virtual sound image in a predetermined position diagonal to the front of a listener or on a side of the listener when the outputs which are obtained in the case where the coefficients of said first and second multipliers are 1.0 and the coefficient of said third multiplier is 0.0 are output directly from said first and second output units, respectively;

plural pieces of sound image information of the same number as said signal input units are input to said localization angle input device;

the coefficients of said first, second, and third multipliers of each of said signal input units are changed according to the sound image localization angle input to said localization angle input device, whereby a desired virtual sound image is localized in a position of each angle input to said localization angle input device; and the sound image localization angle to be input to said localization angle input device can be arbitrarily set within a range obtained by connecting the most distant two positions amongst the following three positions: a position at which the output of said first output unit is emitted to space, a position at which the output of said second output unit is emitted to space, and the predetermined position of the first virtual sound image.

29. The sound image localization apparatus of claim 27, wherein the filter coefficients of the predetermined frequency response of each of said signal input units in the filter device compensate at least one of a sound quality, a change in sound volume, phase characteristics, and delay characteristics amongst the frequency responses of a signal processing section which comprises said first, second, and third multipliers of said input unit, said first and second signal processing devices, and said fourth adder.

30. A sound image localization method for use with the sound image localization apparatus of claim 27, said sound image localization method comprising:

deciding the position of the desired virtual sound image to be input to the localization angle input device by controlling the ratio of the coefficients of the respective multipliers according to the distance from the nearest two positions amongst the following three positions: the position of the first output unit disposed on the left of a listener, the position of the second output unit disposed on the right of the listener, and the position of the virtual sound image realized by using the filter having the predetermined frequency response;

decreasing the coefficient of the second multiplier in order to bring the desired virtual sound image close to the first output unit;

emphasizing the coefficient of the third multiplier in order to bring the desired virtual sound image close to the second output unit; and emphasizing the coefficient of the second multiplier in order to bring the desired virtual sound image close to the virtual sound image realized by using the filter.

31. A sound image localization method for use with the sound image localization apparatus of claim 27, said sound localization method comprising:

setting the coefficients of the filter device according to the input from the localization angle input device so as to compensate at least one of a change in sound volume, a change in phase characteristics, and a change in delay characteristics depending on the change in the frequency response of the sound image or the change in the position of the sound image caused by the change in the coefficients of the first, second, and third multipliers.

32. A sound image localization method for use with the sound image localization apparatus of claim 25, said sound image localization method comprising:

deciding the position of the desired virtual sound image to be input to the localization angle input device by controlling the ratio of the coefficients of the respective multipliers according to the distance from the nearest two positions amongst the following three positions: the position of the first output unit disposed on the left of a listener, the position of the second output unit disposed on the right of the listener, and the position of the virtual sound image realized by using the filter having the predetermined frequency response;

decreasing the coefficient of the second multiplier in order to bring the desired virtual sound image close to the first output unit;

emphasizing the coefficient of the third multiplier in order to bring the desired virtual sound image close to the second output unit; and emphasizing the coefficient of the second multiplier in order to bring the desired virtual sound image close to the virtual sound image realized by using the filter.

* * * * *